US009229420B2

(12) United States Patent
Akiyama et al.

(10) Patent No.: US 9,229,420 B2
(45) Date of Patent: Jan. 5, 2016

(54) COVER OPEN/CLOSE MECHANISM AND IMAGE FORMING APPARATUS INCORPORATING SAME

(71) Applicants: Mami Akiyama, Kanagawa (JP); Yuki Sato, Kanagawa (JP); Shiro Akama, Kanagawa (JP); Yuta Ueda, Tokyo (JP); Hidehiko Maeda, Tokyo (JP)

(72) Inventors: Mami Akiyama, Kanagawa (JP); Yuki Sato, Kanagawa (JP); Shiro Akama, Kanagawa (JP); Yuta Ueda, Tokyo (JP); Hidehiko Maeda, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 21 days.

(21) Appl. No.: 14/189,289

(22) Filed: Feb. 25, 2014

(65) Prior Publication Data

US 2014/0248066 A1 Sep. 4, 2014

(30) Foreign Application Priority Data

Mar. 4, 2013 (JP) ..... 2013-041939

(51) Int. Cl.
*G03G 21/16* (2006.01)
*E05D 3/12* (2006.01)

(52) U.S. Cl.
CPC ..... *G03G 21/1633* (2013.01); *E05D 3/12* (2013.01); *E05Y 2900/608* (2013.01)

(58) Field of Classification Search
CPC .. G03G 21/1623; G03G 21/1633; E05D 7/00; E05D 3/02
USPC ..... 399/107
See application file for complete search history.

(56) References Cited

U.S. PATENT DOCUMENTS

2006/0232176 A1* 10/2006 Kim et al. ..... 312/405
2010/0003050 A1* 1/2010 Minaminaka ..... 399/114
2012/0155916 A1 6/2012 Ito et al.

FOREIGN PATENT DOCUMENTS

JP 2012-126027 7/2012

* cited by examiner

*Primary Examiner* — Erika J Villaluna
(74) *Attorney, Agent, or Firm* — Harness, Dickey & Pierce, P.L.C

(57) ABSTRACT

A cover open/close mechanism, which is included in an image forming apparatus, includes a cover having a free end and disposed movable between a closed state that a part of the apparatus body is covered and an open state that the covered part is exposed, a cover rotating shaft about which the cover rotates in a receding direction when the cover moves from the closed state to the open state, a support member rotating shaft disposed parallel to the cover rotating shaft, a cover rotating shaft support member to support the cover rotating shaft and to change a position of the cover rotating shaft with respect to the apparatus body by rotating about the support member rotating shaft, and a biasing member to bias the cover rotating shaft support member in a manner in which the cover rotating shaft support member rotates in an approaching direction.

7 Claims, 14 Drawing Sheets

COVER OPEN/CLOSE MECHANISM AND IMAGE FORMING APPARATUS INCORPORATING SAME

CROSS-REFERENCE TO RELATED APPLICATIONS

This patent application is based on and claims priority pursuant to 35 U.S.C. §119 to Japanese Patent Application No. 2013-041939, filed on Mar. 4, 2013 in the Japan Patent Office, the entire disclosure of which is hereby incorporated by reference herein.

BACKGROUND

1. Technical Field

Embodiments of the present invention relate to a cover open/close mechanism to open/close a cover unit by pivoting the cover unit that covers a part of an apparatus body, and an image forming apparatus incorporating the cover open/close mechanism.

2. Related Art

An image forming apparatus contains various parts that can be replaced by opening/closing a cover unit of the image forming apparatus. A cover open/close mechanism provided to open/close the cover unit has a typical configuration in which the cover unit is rotatable about its rotating shaft fixed to an apparatus body of the image forming apparatus. In such a cover open/close mechanism, the cover unit rotates about the rotating shaft so that a free end of the cover unit moves in a receding direction from the apparatus body. According to the movement of the free end of the cover unit, the cover unit changes from a closed state in which the cover unit covers a part of the apparatus body to an open state in which the covered part of the apparatus body is exposed. The free end of the cover unit is one of both ends of the cover unit in a direction perpendicular to a longitudinal length of the rotating shaft, and is a positionally changeable part by an opening/closing operation of the cover unit. An opposite end of the free end of the cover unit in the receding direction is referred to as a root end.

In the cover open/close mechanism with the rotating shaft fixed to the apparatus body, any parts or components included in the apparatus body in a manner of facing the cover unit in the closed state are arranged not to interfere with the root end when the cover unit opens or closes.

However, as an example configuration, an image forming apparatus includes a cover open/close mechanism that has a cover rotating shaft at the end of an open/close cover. In this configuration, a hinge part including the cover rotating shaft is exposed outside the image forming apparatus, which is visually awkward. Further, to avoid interference with an apparatus body of the image forming apparatus, the shape of a root end of the open/close cover is limited and a round-shaped root end cannot be formed in the configuration.

As another example configuration, Japanese Patent Application Publication No. JP 2012-126027-A discloses a cover open/close mechanism having a configuration in which a position of a cover rotating shaft with respect to an apparatus body changes so that a surface of a covered part and a cover unit are arranged close to each other without exposing the cover rotating shaft in a closed state of the cover unit. The cover open/close mechanism of JP 2012-126027-A includes a cover rotating shaft support member to support the cover rotating shaft and change the position of the cover rotating shaft with respect to the apparatus body by rotating about a support member rotating shaft that is disposed parallel to the cover rotating shaft.

As yet another example configuration, an image forming apparatus includes a cover open/close mechanism that includes an arm that is freely rotatable in an open state of an open/close cover of the cover open/close mechanism. Due to the arm, the position of a cover rotating shaft and the position of a support member rotating shaft are switched in a widthwise direction of a covered part of an apparatus body of the image forming apparatus, which can cause an unstable open/close operation.

In the above-described cover open/close mechanism, a cover rotating shaft is located closer to a root end side of an open/close cover than to a support member rotating shaft. This configuration causes change in position of the cover rotating shaft and the support member rotating shaft in the widthwise direction in a closed state of the open/close cover. Such inconvenience can also occur when the cover rotating shaft of the cover open/close mechanism is located closer to the free end side of the open/close cover than to the support member rotating shaft.

In the above-described cover open/close mechanism, the cover rotating shaft has an axial center extending in a vertical direction. However, the same inconvenience occurs when the axial center of the cover rotating shaft extends in a horizontal direction.

SUMMARY

At least one embodiment of the present invention provides a cover open/close mechanism including a cover having a free end in a width direction thereof and disposed movable between a closed state in which a part of the apparatus body is covered and an open state in which the covered part of the apparatus body is exposed, a cover rotating shaft about which the cover rotates in a direction in which the free end of the cover separates from the apparatus body when the cover moves from the closed state to the open state, a support member rotating shaft disposed parallel to the cover rotating shaft, a cover rotating shaft support member to support the cover rotating shaft and to change a position of the cover rotating shaft with respect to the apparatus body by rotating about the support member rotating shaft, and a biasing member to bias the cover rotating shaft support member in a manner in which the cover rotating shaft support member rotates in a direction in which the cover rotating shaft approaches the apparatus body.

Further, at least one embodiment of the present invention provides an image forming apparatus including an image forming part to form an image on a recording medium, and the above-described cover open/close mechanism.

BRIEF DESCRIPTION OF THE DRAWINGS

A more complete appreciation of the invention and many of the advantages thereof will be obtained as the same becomes better understood by reference to the following detailed description when considered in connection with the accompanying drawings, wherein.

DETAILED DESCRIPTION

Figure 1:
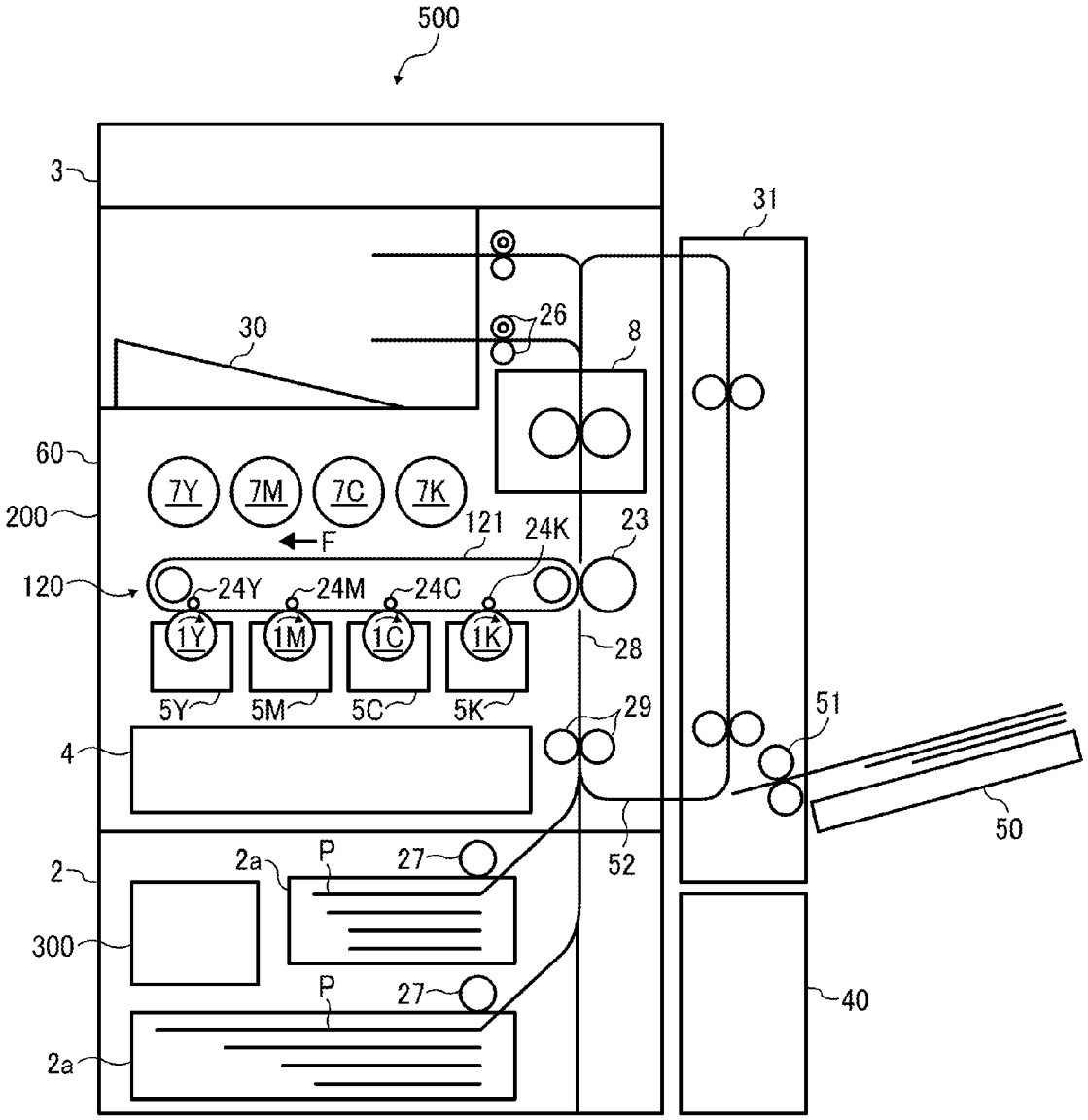
FIG. 1 is a diagram illustrating a schematic entire configuration of an image forming apparatus according to an embodiment of the present invention.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present invention.

The terminology used herein is for describing particular embodiments and is not intended to be limiting of exemplary embodiments of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of the present invention. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of the present invention.

The present invention is applicable to any image forming apparatus, and is implemented in the most effective manner in an electrophotographic image forming apparatus.

In describing preferred embodiments illustrated in the drawings, specific terminology is employed for the sake of clarity. However, the disclosure of the present invention is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of the present invention are described.

A description is given of an example of a configuration of an image forming apparatus 500 according to an embodiment of the present invention, with reference to FIG. 1.

FIG. 1 is a diagram illustrating a schematic entire configuration of the image forming apparatus 500. The image forming apparatus 500 shown in FIG. 1 is a color image forming apparatus to form a full color image based on image data of four different single color toners, which are yellow (Y), cyan (C), magenta (M), and black (K).

The image forming apparatus 500 may be a copier, a facsimile machine, a printer, a multifunction peripheral or a multifunction printer (MFP) having at least one of copying, printing, scanning, facsimile, and plotter functions, or the like. According to the present embodiment, the image forming apparatus 500 is an electrophotographic color printer that forms color and monochrome toner images on recording media by electrophotography.

The image forming apparatus 500 has an apparatus body 200 that includes an image forming part 60, a sheet feeding part 2, and a scanner 3. The scanner 3 functions as an image reading device to read an image on an original document that is a target for image formation. The image forming apparatus 500 further includes a reverse unit 31 disposed on the right side of the image forming part 60 shown in FIG. 1. The reverse unit 31 functions as a sheet reversing and conveying member.

The image forming part 60 includes four image forming devices 5Y, 5M, 5C, and 5K to form respective single color images. The image forming devices 5Y, 5M, 5C, and 5K are aligned along a moving direction of an intermediate transfer belt 121 as indicated by arrow F of FIG. 1. The intermediate transfer belt 121 is an endless loop. The image forming devices 5Y, 5M, 5C, and 5K include photoconductors 1Y, 1M, 1C, and 1K, respectively. Each of the photoconductors 1Y, 1M, 1C, and 1K functions as a drum-shaped image carrier.

The image forming part 60 further includes an exposure device 4, the intermediate transfer unit 120 including the intermediate transfer belt 121, and a fixing unit 8.

The intermediate transfer unit 120 integrally includes primary transfer rollers 24Y, 24M, 24C, and 24K, a secondary transfer roller 23, and an intermediate transfer belt cleaning unit. The intermediate transfer unit 120 is detachably attached to the apparatus body 200 of the image forming apparatus 500.

The primary transfer rollers 24Y, 24M, 24C, and 24K are disposed in contact with an inner circumferential surface of the intermediate transfer belt 121 to transfer toner images from the respective surfaces of the photoconductors 1Y, 1M, 1C, and 1K onto an outer circumferential surface of the intermediate transfer belt 121. Accordingly, a color toner image sequentially overlaid is held on the intermediate transfer belt 121.

The secondary transfer roller 23 is disposed downstream from the primary transfer rollers 24Y, 24M, 24C, and 24K in a sheet conveying direction and facing the outer circumferential surface of the intermediate transfer belt 121.

The intermediate transfer belt cleaning unit is disposed downstream from the secondary transfer roller 23 in the sheet conveying direction to clean the outer circumferential surface of the intermediate transfer belt 121.

It is to be noted that the image forming devices 5Y, 5M, 5C, and 5K, the exposure device 4, the intermediate transfer unit 120, and the fixing unit 8 form an image forming section to form an image read by the scanner 3 based on image data on a transfer sheet P functioning as a recording medium.

The scanner 3 disposed above the image forming part 60 includes a first moving unit having a light source, a second moving unit having mirrors, an image forming lens, and an image reading sensor.

The exposure device 4 is disposed below the image forming devices 5Y, 5M, 5C, and 5K.

The sheet feeding part 2 is disposed below the image forming part 60. The sheet feeding part 2 includes sheet containers 2*a* in which a stack of transfer sheets including the transfer sheet P is contained, and feed rollers 27 each functioning as a sheet feeder.

The fixing unit 8 is disposed above the secondary transfer roller 23 to fix an image formed on the transfer sheet P to the transfer sheet P.

A sheet discharging roller pair 26 is also disposed above the secondary transfer roller 23 to discharge the transfer sheet P having the image fixed to the transfer sheet P.

The image forming devices 5Y, 5C, 5M, and 5K form respective single color images of yellow (Y), cyan (C), magenta (M), and black (K), which are different from each other corresponding to color separation of a color image. Elements and components of the image forming devices 5Y, 5C, 5M, and 5K are similar in structure and functions, except that the respective single colors are different from each other. Hereinafter, the image forming devices 5Y, 5C, 5M, and 5K are also referred to as the image forming device 5.

The image forming device 5 includes various image forming units disposed around the photoconductor 1 (i.e., the photoconductors 1Y, 1C, 1M, and 1K). The image forming units are, for example, a charger, a development unit, and a cleaning unit. The charger uniformly charges a surface of the photoconductor 1 for forming an electrostatic latent image on the surface of the photoconductor 1. The development unit develops the electrostatic latent image into a visible toner image by supplying a color toner onto the electrostatic latent image. The cleaning unit cleans the surface of the photoconductor 1 after transfer of the toner image.

Next, a description is given of examples of image forming operations performed by the image forming apparatus 500 according to the present embodiment.

On receipt of a signal to start image forming, the intermediate transfer belt 121 starts to rotate to move the surface thereof. At the same time, in the image forming device 5, the charger uniformly charges the surface of the photoconductor 1, and the exposure device 4 emits laser light to irradiate the surface of the photoconductor 1 for forming an electrostatic latent image thereon. The electrostatic latent image is developed by the development unit to form a visible toner image on the surface of the photoconductor 1. Along with movement of the outer circumferential surface of the intermediate transfer belt 121, the toner images formed on the respective photoconductors 1 are sequentially transferred with the aid of the primary transfer roller 24 (i.e., the primary transfer rollers 24Y, 24M, 24C, and 24K) onto the intermediate transfer belt 121 to form a composite color toner image.

It is to be noted that the image forming operations for respective toner colors are performed by gradually shifting respective timings along an upstream side to a downstream side of the intermediate transfer belt 121 in the sheet conveying direction, so that the respective toner images are overlaid at the same position on the intermediate transfer belt 121.

By contrast, the transfer sheet P is fed from a selected one of the sheet containers 2*a* via the corresponding feed roller 27, and is then conveyed to a secondary transfer nip area formed by the intermediate transfer belt 121 and the secondary transfer roller 23. At the secondary transfer nip area, the composite color toner image formed on the intermediate transfer belt 121 is transferred onto the transfer sheet P by the secondary transfer roller 23. After the secondary transfer, the transfer sheet P is conveyed to the fixing unit 8 where the composite color toner image is fused and fixed to the transfer sheet P. The transfer sheet P having the composite color toner image fixed thereto in the fixing unit 8 is determined whether to be conveyed to a sheet discharging tray 30 on which the transfer sheet P is stacked or to be conveyed to the reverse unit 31 for duplex printing.

Further, the cleaning unit removes residual toner remaining on the photoconductor 1 after transfer of the composite color toner image to clean the surface of the photoconductor 1. Similarly, the intermediate transfer belt cleaning unit removes residual toner remaining on the intermediate transfer belt 121 after transfer of the composite color toner image to clean the surface of the intermediate transfer belt 121. The residual toner collected and recovered from the surface of the photoconductor 1 is conveyed as waste toner by a photoconductor waste toner conveying screw disposed in the cleaning unit and is discharged to a waste toner bottle 300 disposed in the image forming apparatus 500. Further, the residual toner removed and collected from the surface of the intermediate transfer belt 121 is conveyed as waste toner by a belt waste toner conveying screw disposed in the intermediate transfer belt cleaning unit and is discharged to the waste toner bottle 300 disposed in the image forming apparatus 500.

Toner bottles 7Y, 7M, 7C, and 7K are disposed at an upper left side, which is above the intermediate transfer unit 120. The toner bottle 7 (i.e., the toner bottles 7Y, 7M, 7C, and 7K) is filled with respective color toner (i.e., yellow, magenta, cyan, and black toners) and is connected to the development unit via a conveying path. After consumption of a certain amount of toner in the development unit for image forming, a given amount of toner is supplied from the toner bottle 7 (i.e., the toner bottles 7Y, 7M, 7C, and 7K) to the development unit.

Figure 2:
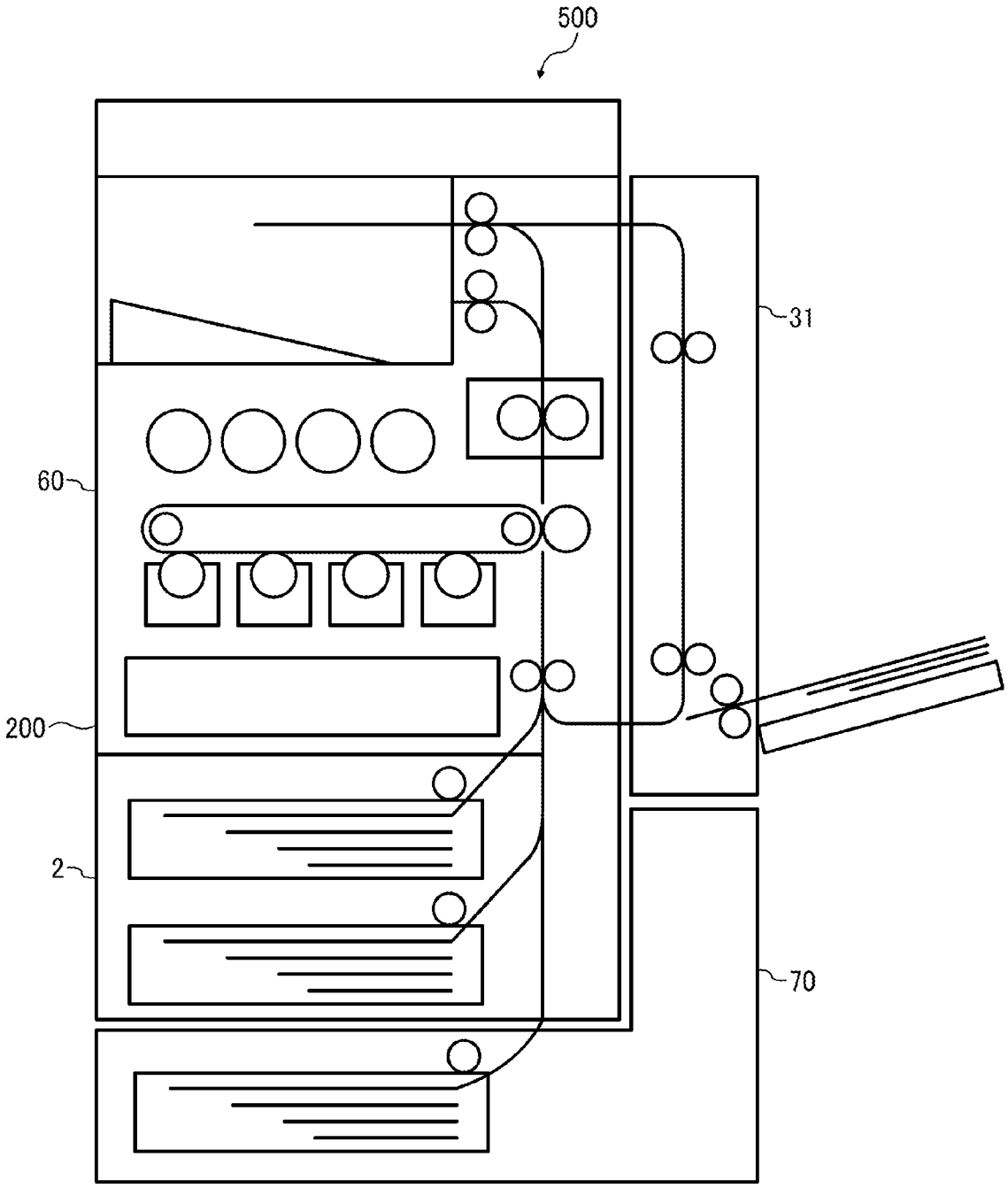
FIG. 2 is a diagram illustrating an example of another schematic configuration of the image forming apparatus of FIG. 1, which includes a second sheet feed tray.

It is to be noted that the order of alignment of the image forming devices 5Y, 5M, 5C, and 5K and the toner bottles 7Y, 7M, 7C, and 7K are not limited to the example alignment as illustrated in FIG. 2.

To produce a copy of an original document in the image forming apparatus 500 according to the present embodiment, the sheet-like original document is set on the scanner 3. After the original document is set, a copy start switch is pressed to start the scanner 3 to scan of the original document. In the image reading operation, the first moving unit and the second moving unit start moving, and the first moving unit emits a laser light beam from a light source provided thereon. The reflection light reflected by a surface of the original document is then reflected by a mirror provided on the second moving unit, and passes through an image forming lens. Then, the reflection light enters in an image sensor. Thereafter, the image sensor forms image data based on the entered light.

Simultaneously with the image reading operation, elements and components included in the image forming devices 5Y, 5M, 5C, and 5K, the intermediate transfer unit 120, the secondary transfer roller 23, and the fixing unit 8 start driving. Based on image data read by the scanner 3, the exposure device 4 is driven to form respective yellow, magenta, cyan, and black toner images on the photoconductors 1Y, 1M, 1C, and 1K, respectively. These single color toner images are sequentially transferred onto the surface of the intermediate transfer belt 121 in an overlaid manner, thereby forming a four-color toner image.

Substantially simultaneously with the start of the image reading operation, a sheet feeding operation starts in the sheet feeding part 2. In the sheet feeding operation, a selected one of the feed rollers 27 is rotated to feed the transfer sheet P from the corresponding one of the sheet containers 2*a* disposed vertically in the sheet feeding part 2. The transfer sheet P fed from the selected sheet container 2*a* is separated one by one from the remaining sheets in the sheet container 2*a* by the corresponding feed roller 27. Then, the transfer sheet P enters in a sheet conveying path 28, through which the transfer sheet P is conveyed to the secondary transfer nip area by a conveying roller pair 29.

Instead of the sheet container(s) 2*a*, the transfer sheet P can be fed from a bypass tray 50. When the bypass tray 50 is used, a bypass feed roller 51 rotates to feed the transfer sheet P placed on the bypass tray 50, and then the transfer sheet P is conveyed one by one to a bypass conveying path 52.

In the present embodiment, the reverse unit 31 is located higher than the sheet feeding part 2 on the right side of the image forming part 60. Accordingly, there is an empty area or space under the reverse unit 31, which decreases quality of external appearance of the image forming apparatus 500. Further, the space may be used as a handle when the image forming apparatus 500 is held or moved, which can damage the reverse unit 31. According to these reasons, the image forming apparatus 500 according to the present embodiment is provided with an external cover 40 attached under the reverse unit 31 on the right side of the sheet feeding part 2 in FIG. 1. As a result, not only the quality of external appearance of the image forming apparatus 500 is enhanced but also the reverse unit 31 is not used as a handle when the image forming apparatus 500 is moved.

Alternatively, the image forming apparatus 500 can have an optional second sheet feeding part 70 disposed below the sheet feeding part 2 as illustrated in FIG. 2. When attaching the second sheet feeding part 70 to the image forming apparatus 500, the external cover 40 is removed to replace with the second sheet feeding part 70.

Next, a description is given of a cover open/close mechanism 100.

Image forming apparatuses such as the image forming apparatus 500 includes consumable parts disposed inside an apparatus body thereof. For replacement of the consumable parts, each image forming apparatus is required that a user can easily open/close an external cover that is provided to cover an area where the consumable parts are disposed. The cover open/close mechanism 100 opens/closes an open/close cover 10 when replacing the waste toner bottle 300. The open/close cover 10 is a part of an external cover of the image forming apparatus 500.

When the waste toner bottle 300 is replaced, the cover open/close mechanism 100 that opens/closes an open close cover that is a part of an exterior cover of the image forming apparatus 500.

Figure 3:
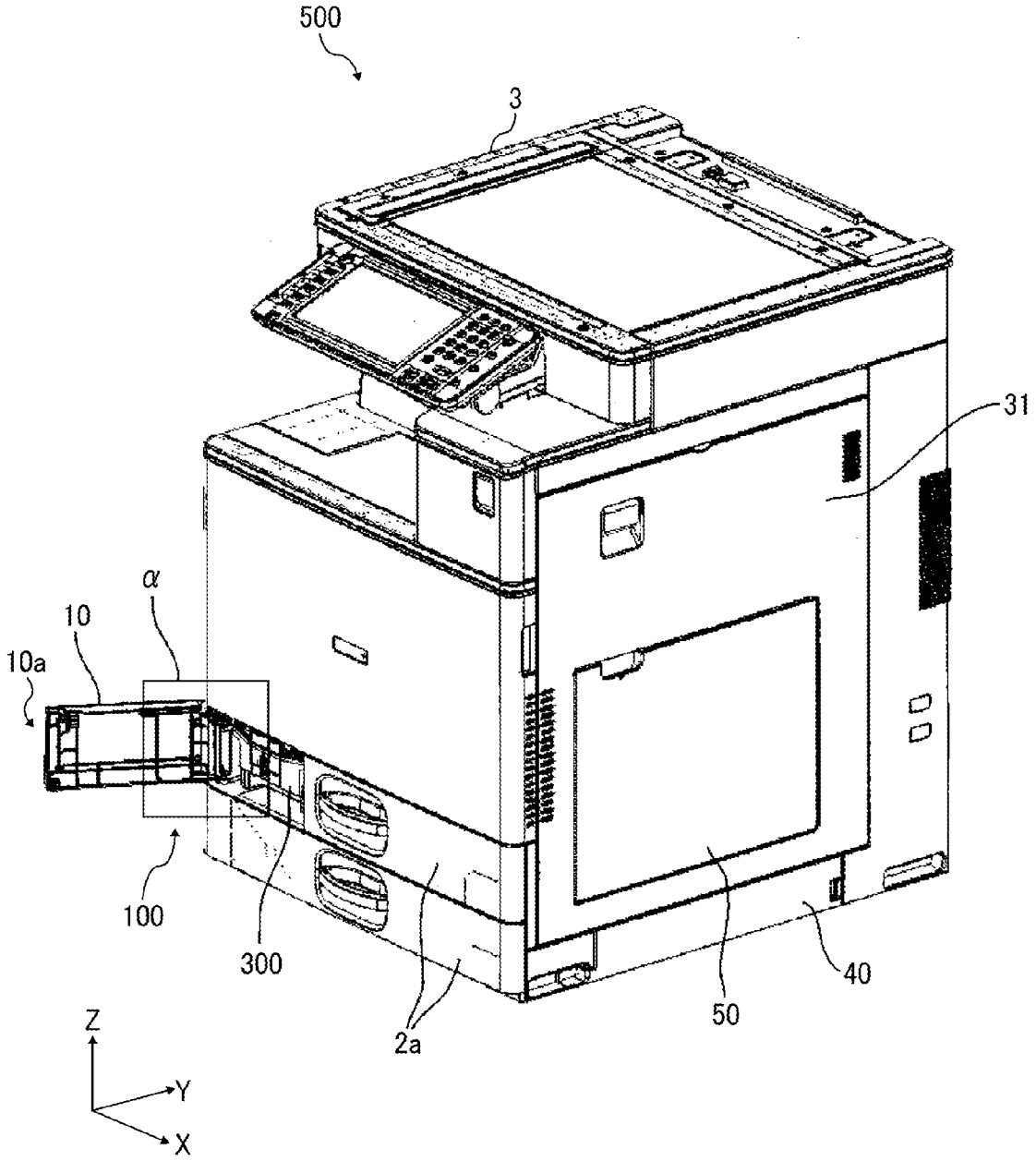
FIG. 3 is a perspective view illustrating the image forming apparatus with an open/close cover in an open state.
Figure 4:
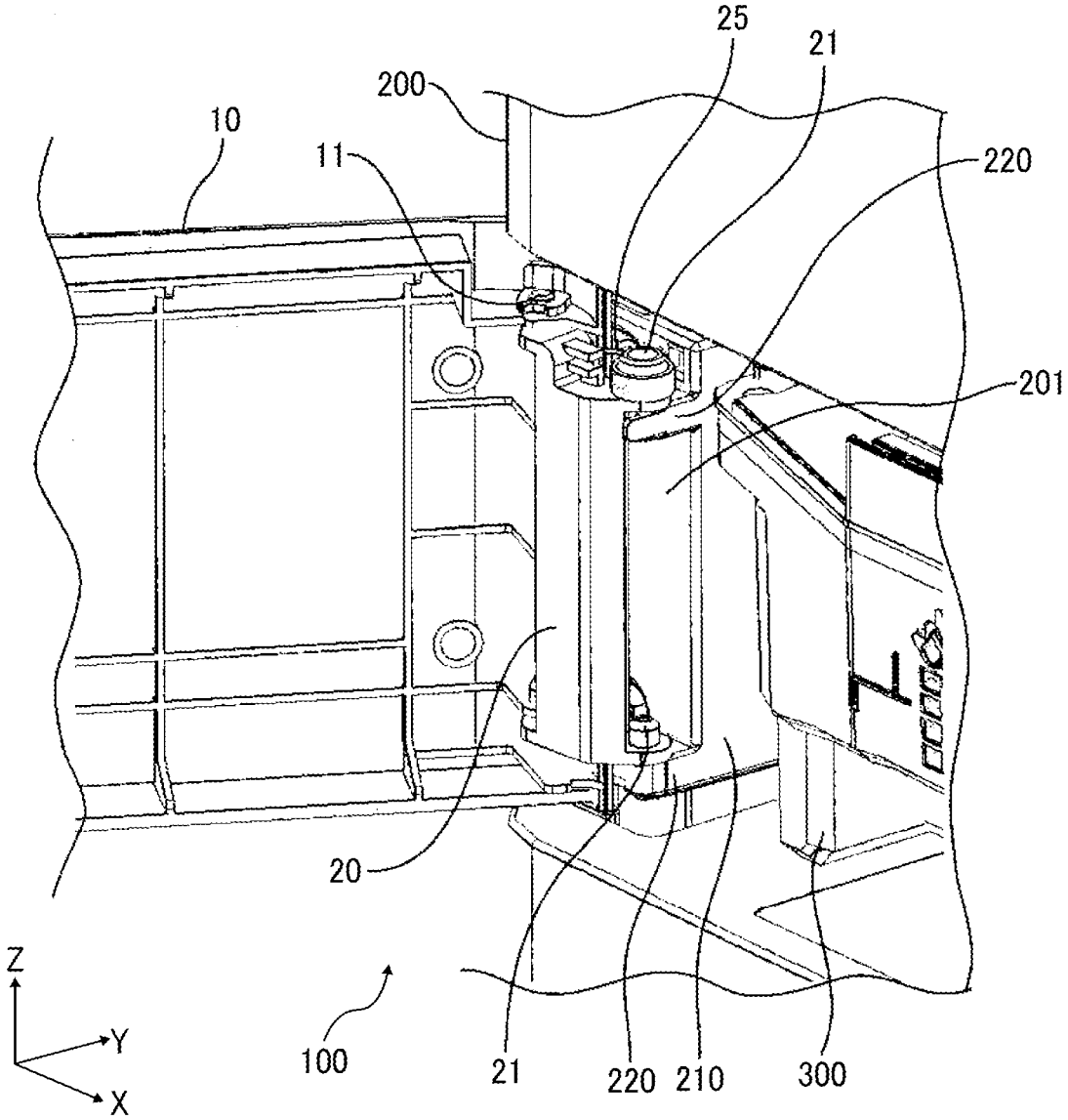
FIG. 4 is an enlarged view of a region cc in FIG. 3.

FIG. 3 is a perspective view illustrating the image forming apparatus 500 when the open/close cover 10 of the cover open/close mechanism 100 is opened (in an open state) for replacing the waste toner bottle 300. FIG. 4 is an enlarged view of a region c' shown in FIG. 3. In FIGS. 3 and 4, an X-axis direction indicates a widthwise direction of the image forming apparatus 500, a Y-axis direction indicates a depth direction thereof, and a Z-axis direction indicates a vertical direction thereof.

As illustrated in FIGS. 3 and 4, the waste toner bottle 300 can be attached/detached by opening the open/close cover 10. In the present embodiment, the waste toner bottle 300 is an example of a replaceable consumable part. However, the replaceable consumable part or component is not limited thereto. For example, an image forming unit or other units can be a consumable part to be replaced by using a cover open/close mechanism such as the cover open/close mechanism 100.

FIGS. 5 through 13 shows various views of the cover open/close mechanism 100.

Figure 5:
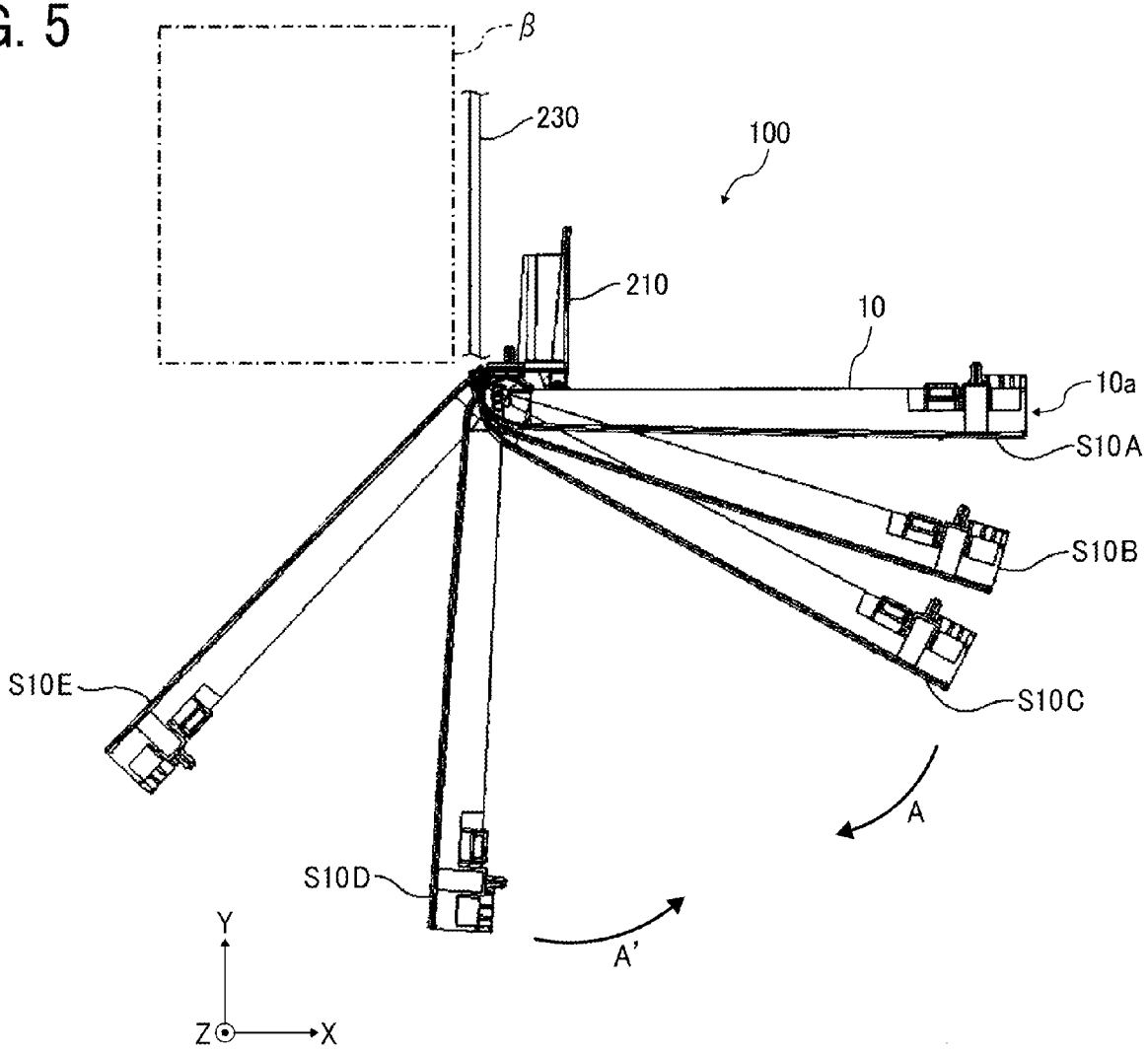
FIG. 5 is a plan view of a cover open/close mechanism according to an embodiment of the present invention.
Figure 6:
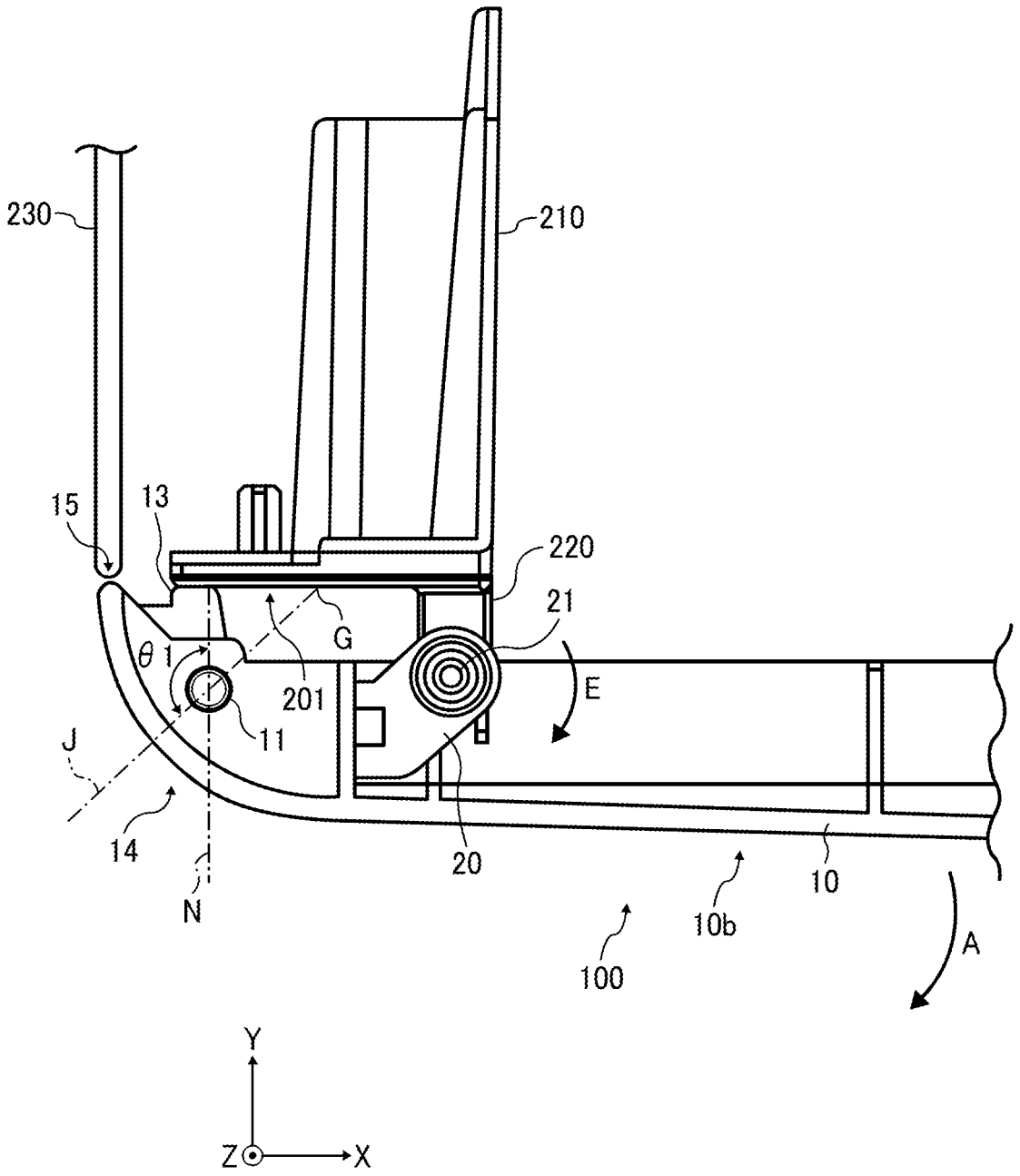
FIG. 6 is an enlarged plan view illustrating an area in a vicinity of an open/close cover rotating shaft of the cover open/close mechanism with the open/close cover is in a closed state.
Figure 7:
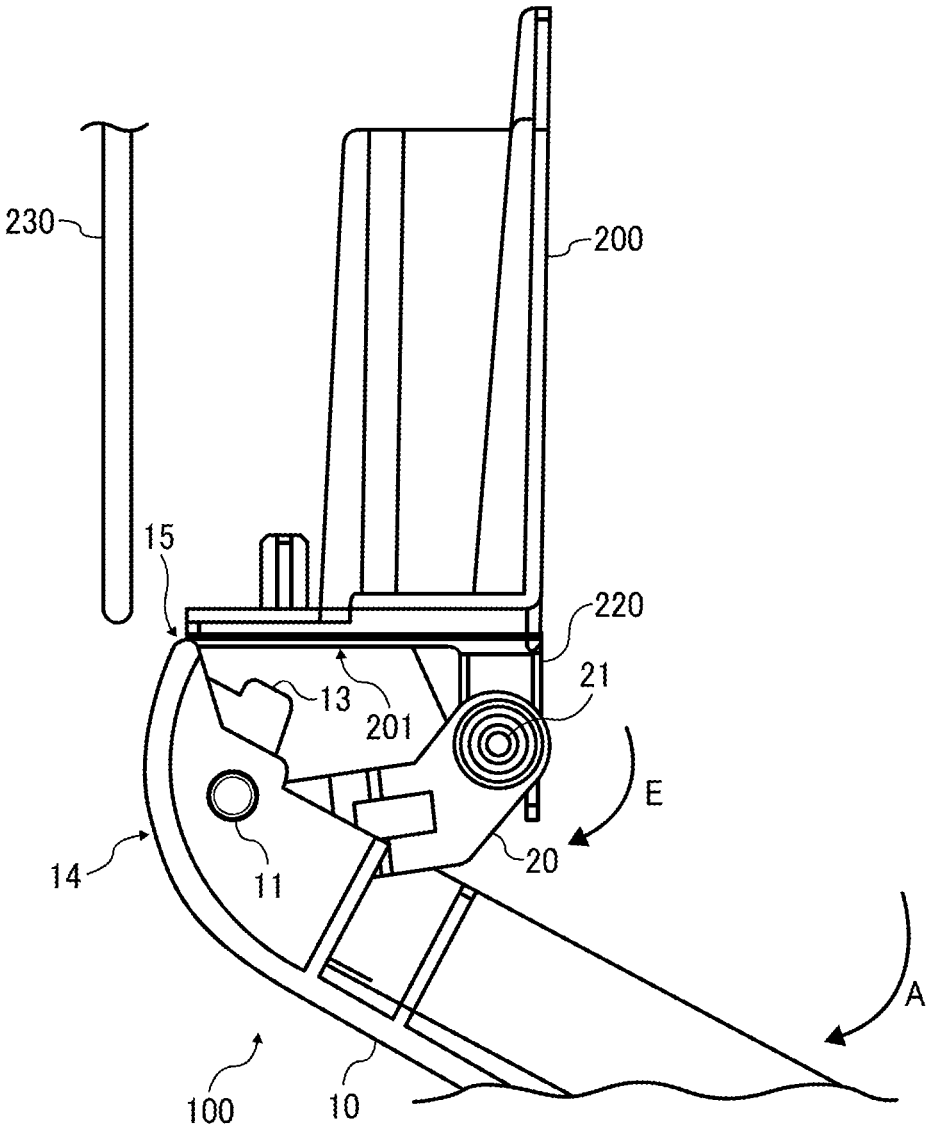
FIG. 7 is an enlarged plan view illustrating the cover open/close mechanism according to an embodiment, where an area in the vicinity of the open/close cover rotating shaft of the cover open/close mechanism is in a middle stage of the open state.
Figure 8:
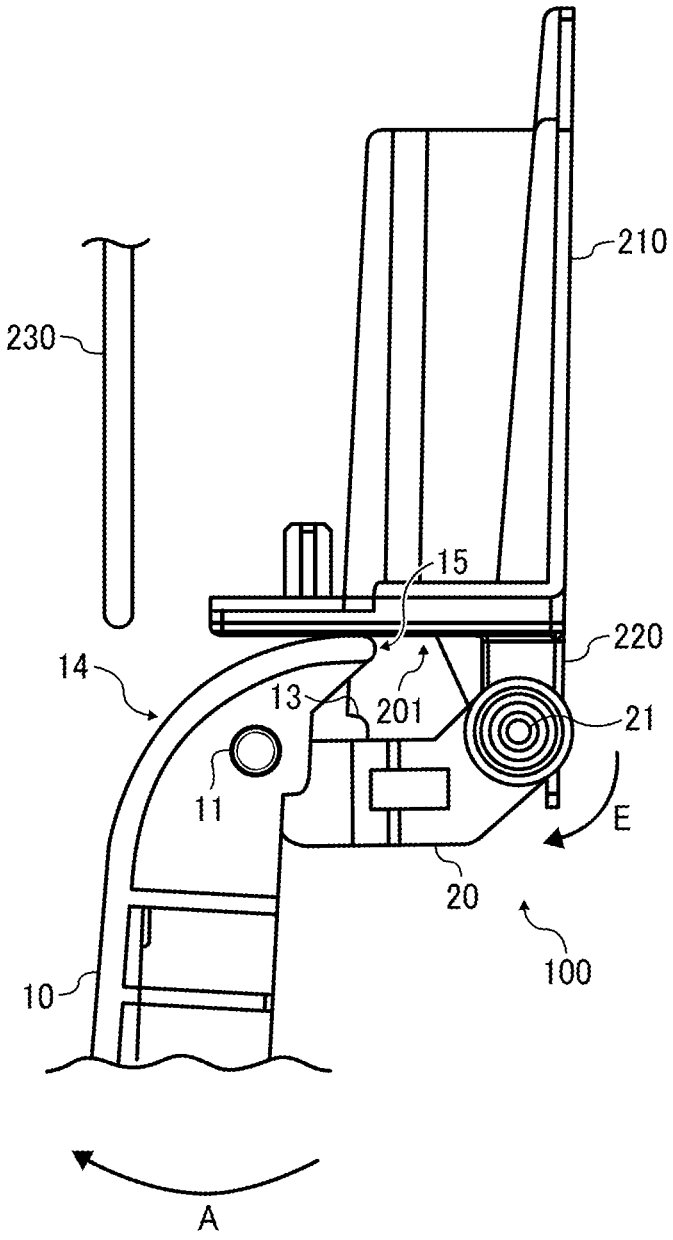
FIG. 8 is an enlarged plan view illustrating the cover open/close mechanism according to an embodiment, where the area in the vicinity of the open/close cover rotating shaft of the cover open/close mechanism is in another middle stage of the open state.
Figure 9:
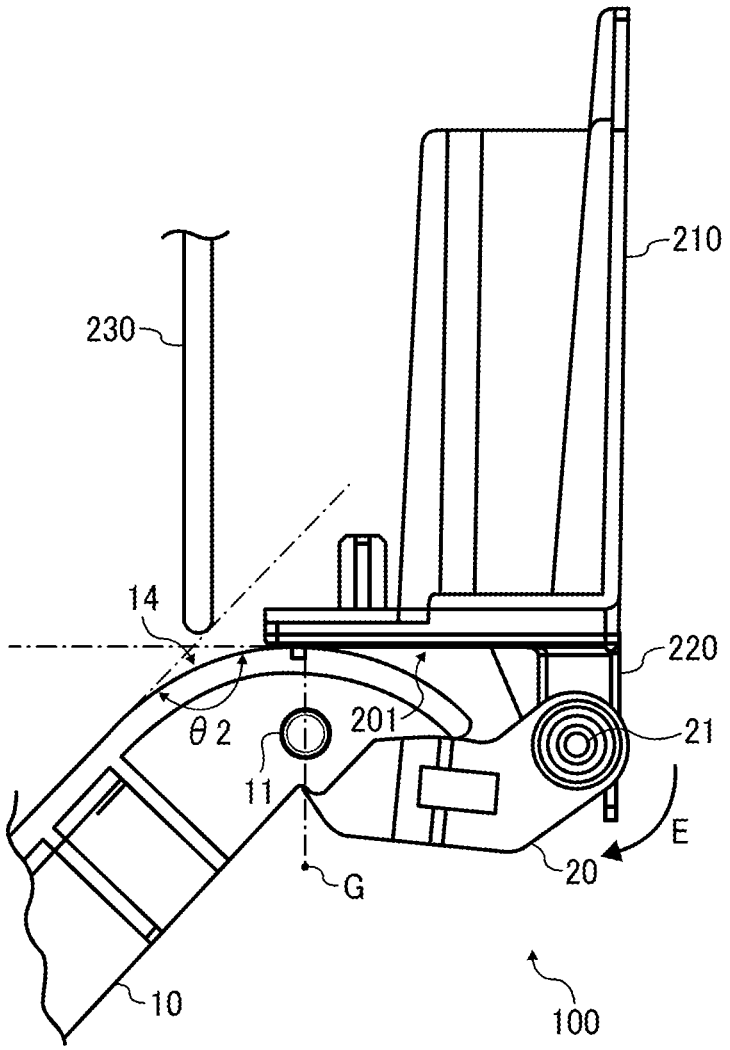
FIG. 9 is an enlarged plan view illustrating the cover open/close mechanism according to an embodiment, where the area in the vicinity of the open/close cover rotating shaft of the cover open/close mechanism is in a fully opened stage of the open state.

FIG. 5 is a plan view illustrating the cover open/close mechanism 100 and shows rotation loci of the open/close cover 10 in stages according to reference numerals S10A through S10D. FIG. 6 is an enlarged view illustrating an area in a vicinity of a rotating shaft of the open/close cover 10 of the cover open/close mechanism 100 in a closed state, which is a stage S10A of the rotation locus of the open/close cover 10 in FIG. 5. FIG. 7 illustrates the open/close cover 10 in a stage S10C of the rotation locus of the open/close cover 10. FIG. 8 illustrates the open/close cover 10 in a stage S10D of the rotation locus of the open/close cover 10. FIG. 9 illustrates the open/close cover 10 in a stage S10E, which is a full open state.

The cover open/close mechanism 100 includes the open/close cover 10, a cover rotating shaft 11, an arm 20, an arm rotating shaft 21, and an internal component 210.

The internal component 210 is fixed to the apparatus body 200 of the image forming apparatus 500. A part of the internal component 210 protrudes toward a front side (a lower side in FIGS. 5 and 6) of the apparatus body 200 to function as an arm rotating shaft support member 220 that supports the arm rotating shaft 21.

The open/close cover 10 in the closed state (the stage S10A in FIG. 5) rotates about the cover rotating shaft 11 in a direction indicated by arrow A in FIG. 5 about the cover rotating shaft 11. Hereinafter, the direction indicated by arrow A is referred to as a direction A. According to this rotation, a free end 10*a* of the open/close cover 10 moves in a receding direction from the apparatus body 200. This rotation changes the state of the open/close cover 10 to an open state (i.e., a stage S10E of the rotation locus of the open/close cover 10 in FIG. 5) to open a part of the apparatus body 200.

As illustrated in FIG. 6, the arm 20 functions as a cover rotating shaft support member that supports the cover rotating shaft 11 and rotates about the arm rotating shaft 21 that functions as a support member rotating shaft that is disposed parallel to the cover rotating shaft 11. Therefore, the arm 20 changes the position of the cover rotating shaft 11 with respect to the apparatus body 200.

The cover open/close mechanism 100 further includes a pressing member 25 (as illustrated in FIG. 4). The pressing member 25 functions as a biasing member to bias the arm 20 so that the arm 20 rotates about the arm rotating shaft 21 in a direction indicated by arrow E in FIG. 6. Hereinafter, the direction indicated by arrow E is referred to as a direction E.

The arm 20 functions as a hinging member of the open/close cover 10. The open/close cover 10 is rotatable about the cover rotating shaft 11 with respect to the arm 20.

The arm 20 is provided with the arm rotating shaft 21 together with the cover rotating shaft 11 that rotatably supports the open/close cover 10. The arm rotating shaft 21 connects the arm 20 rotatably to the arm rotating shaft support member 220 of the internal component 210 that is fixed to the apparatus body 200.

The pressing member 25 is disposed around an axis of the arm rotating shaft 21 to press the arm 20 so that the cover rotating shaft 11 supported by the arm 20 approaches the apparatus body 200. In the present embodiment, the pressing member 25 is a torsion spring. However, the pressing member 25 is not limited thereto and can be any other biasing member such as a leaf spring or a linear spring.

It is to be noted that a region β shown in FIG. 5 is an area where any extension device can be installed.

As shown in FIG. 6, when the open/close cover 10 is in the closed state, the cover rotating shaft 11 and the arm rotating shaft 21 are located closer to the free end 10*a* of the open/close cover 10 than to a cover end 15 that is a root end of the open/close cover 10. That is, the cover rotating shaft 11 falls within a range in a drawing in which the open/close cover 10 in the closed state is projected parallel to the Y-axis direction in FIG. 6. In this configuration, when the open/close cover 10 is closed, the open/close cover 10 covers the hinging member including the cover rotating shaft 11, the arm 20, and the arm rotating shaft 21, so that the quality of the external appearance of the image forming apparatus 500 can be enhanced.

Figure 10A:
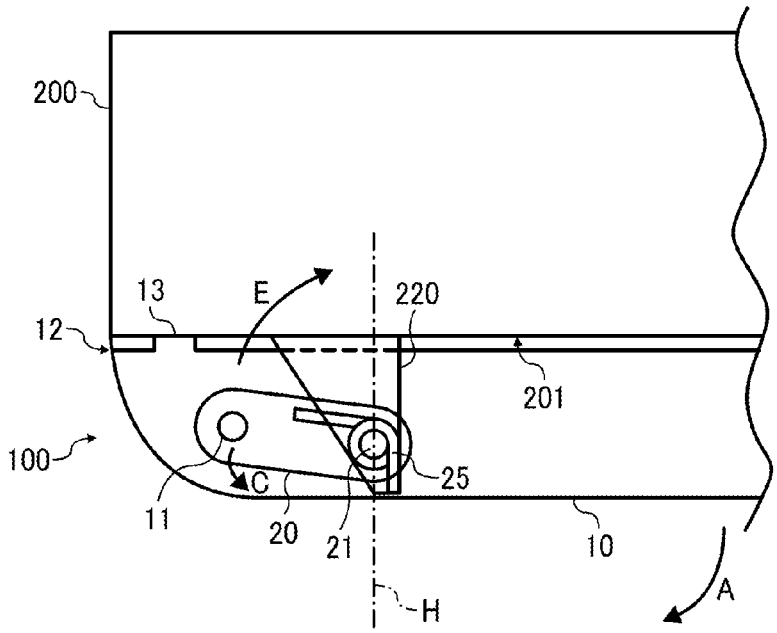
FIG. 10A is a plan view illustrating the cover open/close mechanism in the closed state.
Figure 10B:
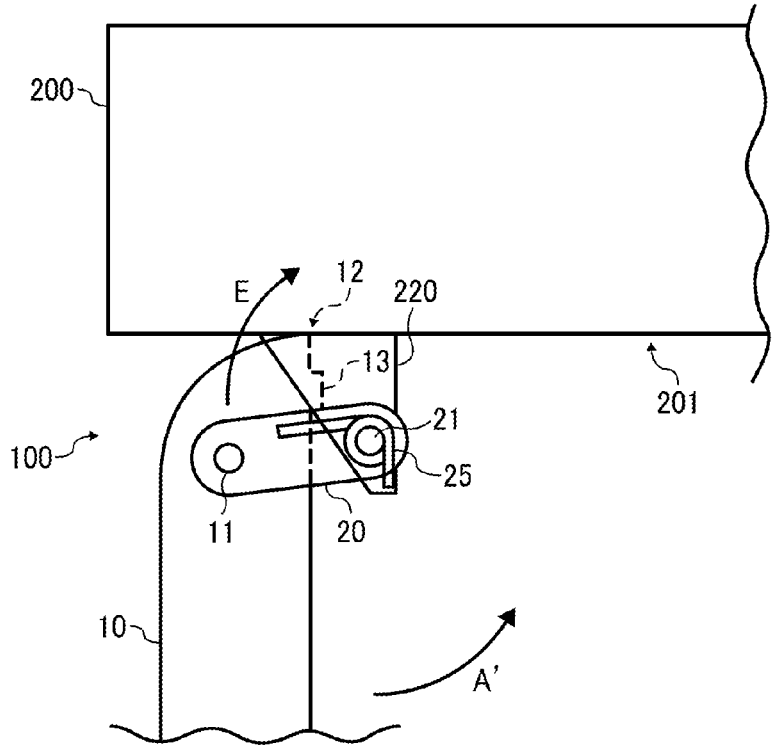
FIG. 10B is a plan view illustrating the cover open/close mechanism of FIG. 10A in the open state.

A configuration of the cover open/close mechanism 100 according to the present embodiment is described here, with reference to FIGS. 10A and 10B.

FIG. 10A is a plan view illustrating the cover open/close mechanism 100 in the closed state, and FIG. 10B is a plan view illustrating the cover open/close mechanism 100 in the open state.

As illustrated in FIGS. 10A and 10B, the cover open/close mechanism 100 includes the open/close cover 10 and the arm 20. The cover open/close mechanism 100 further includes the pressing member 25 to bias the arm 20 so that the arm 20 rotates in the direction E in which the cover rotating shaft 11 approaches the apparatus body 200.

When changing the cover open/close mechanism 100 from the closed state to the open state, an operator pulls the open/close cover 10 to the front side of the apparatus body 200 (to the lower side in FIGS. 10A and 10B) to rotate the open/close cover 10 in the direction A in FIG. 10A. This rotation of the open/close cover 10 moves the free end 10*a* of the open/close cover 10 to the front side of the apparatus body 200. Accordingly, a root side corner 12 abuts against a surface of a covered part 201 that is a part covered with the open/close cover 10. The root side corner 12 is an end corner of the root end (e.g., the cover end 15) opposite to the free end 10*a* with the cover rotating shaft 11 interposed therebetween in the open/close cover 10. When the operator further moves the open/close cover 10 while the root side corner 12 is in contact with the surface of the covered part 201, the root side corner 12 presses the surface of the covered part 201, which exerts a force by the covered part 201 pushing back the root side corner 12. In response to the force, the arm 20 rotates about the arm rotating shaft 21 in a direction indicated by arrow C (hereinafter, the direction C) in FIG. 10A so that the cover rotating shaft 11 separates from the covered part 201.

The rotation of the arm 20 in the direction C moves the cover rotating shaft 11 in the direction to separate from the covered part 201. As the cover rotating shaft 11 separates from the covered part 201, the open/close cover 10 rotates so that the root side corner 12 moves along the surface of the covered part 201. With this action, the open/close cover 10 can open/close without interference of the root side corner 12 with the covered part 201.

Figure 11A:
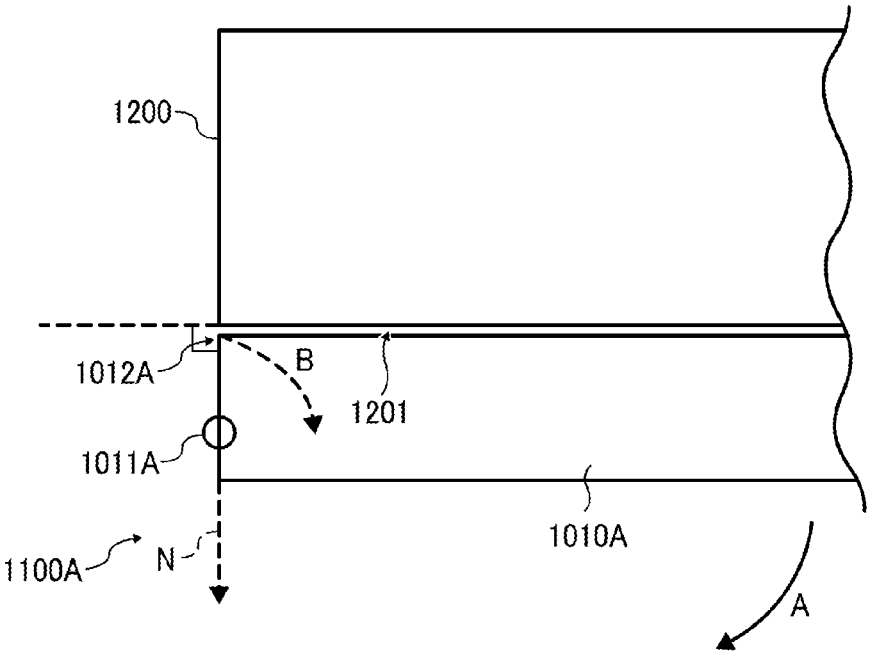
FIG. 11A is an enlarged top plan view illustrating a comparative cover open/close mechanism in a closed state including a cover rotating shaft that is attached to an apparatus body and that is disposed at a root end of an open/close cover of the cover open/close mechanism.
Figure 11B:
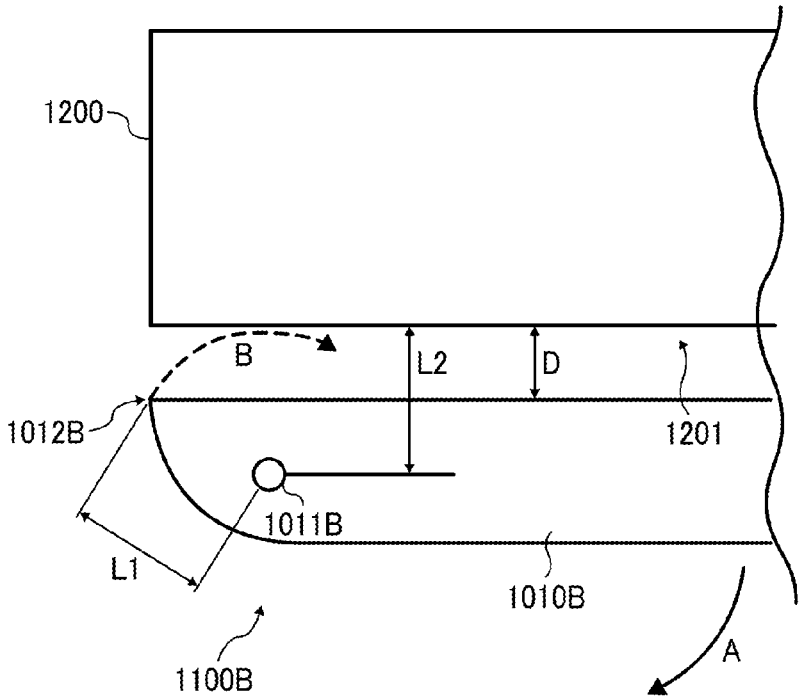
FIG. 11B is an enlarged top plan view illustrating another comparative cover open/close mechanism in a closed state including a cover rotating shaft that is attached to an apparatus body and that is disposed separate from a root end of an open/close cover toward a free end of the open/close cover.

As a comparative example, a description is given of a configuration of a cover open/close mechanism 1100A and an area in the vicinity thereof with reference to FIGS. 11A and 11B. FIGS. 11A and 11B are enlarged top plan views illustrating comparative cover open/close mechanisms 1100A and 1100B. FIG. 11A illustrates the comparative cover open/close mechanism 1100A in a closed state including a cover rotating shaft 1011A that is attached to an apparatus body 1200 and that is disposed at a root end of an open/close cover 1010A. FIG. 11B illustrates the comparative cover open/close mechanism 1100B in a closed state including a cover rotating shaft 1011B that is attached to the apparatus body 1200 and that is disposed separate from a root end of an open/close cover 1010B toward a free end of the open/close cover 1010B.

The free end of the cover open/close mechanism 1100A in FIG. 11A is an end portion of the open/close cover 1010A on a right side of the drawings. The free end of the cover open/close mechanism 1100B in FIG. 11B is an end portion of the open/close cover 1010B on the right side of the drawings, and is located in a same manner as the free end of the cover open/close mechanism 1100A in FIG. 11A. Therefore, the following description regarding the free end of the cover open/close mechanism 1100B common to that of the cover open/close mechanism 1100A is omitted or shortened. The open/close cover 1010A (1010B) rotates about the cover rotating shaft 1011A (1011B) in the direction A so as to move the free end in the receding direction away from the apparatus body 1200, which is a downward direction in FIG. 11A (FIG. 11B). This rotation causes the cover open/close mechanism 1100A (1100B) to change to the open state to expose a part of the apparatus body 1200 that is covered with the cover open/close mechanism 1100A (1100B). In the closed state as illustrated in FIGS. 11A and 11B, a surface of a covered part 1201 of the apparatus body 1200 comes to a position facing the open/close cover 1010A (1010B).

As illustrated in FIG. 11A, the cover open/close mechanism 1100A has the cover rotating shaft 1011A at the root end of the open/close cover 1010A. In this configuration of the cover open/close mechanism 1100A, when the open/close cover 1010A is rotated in the direction A in FIG. 11A, the root side corner 1012A that corresponds to an opposite end corner of a root end to the free end rotates about the cover rotating shaft 1011A in a direction indicated by arrow B (hereinafter, a direction B) in FIG. 11A. In FIG. 11A, the cover rotating shaft 1011A is located on a normal line N that passes the root side corner 1012A among normal lines of the covered part 1201. Therefore, the state shown in FIG. 11A is a state in which the root side corner 1012A makes a closest approach to the covered part 1201. In the state of the open/close cover 1010A shown in FIG. 11A, the root side corner 1012A does not contact the covered part 1201. Therefore, even when the open/close cover 1010A is located close to the covered part 1201 in the closed state of the open/close cover 1010A, the root side corner 1012A does not interfere with the covered part 1201 of the apparatus body 1200.

However, in the configuration shown in FIG. 11A, the cover rotating shaft 1011A (i.e., a hinge part including the cover rotating shaft 1011A) is exposed outside when the open/close cover 1010A is in the closed state, which is visually awkward. Further, since the cover rotating shaft 1011A is located on the normal line N, the shape of the root end of the open/close cover 1010A is limited, and therefore a round-shaped root end cannot be employed (for example, a root end of the open/close cover 1010B as illustrated in FIG. 11B).

By contrast, in the configuration of the cover open/close mechanism 1100B as illustrated in FIG. 11B, the cover rotating shaft 1011B is located closer to the free end of the open/close cover 1010B than to the root end thereof, and therefore is not exposed even when the open/close cover 1010B is in the closed state. Further, the root end of the open/close cover 1010B is round-shaped.

In FIG. 11B, the root side corner 1012B has not reached a position where the root side corner 1012B makes a closest approach to the covered part 1201 in the closed state. As the open/close cover 1010B rotates about the cover rotating shaft 1011B in the direction A, when the root side corner 1012B moves along a track in the direction B, the root side corner 1012B is located at a position where the root side corner 1012B does not interfere with the covered part 1201.

To achieve the above-described locations, a distance L2 from the surface of the covered part 1201 to the cover rotating shaft 1011B is set to be greater than a distance L1 from the root side corner 1012B to the cover rotating shaft 1011B. However, as illustrated in FIG. 11B, this arrangement forms a gap indicated by arrow D in FIG. 11B between the covered part 1201 and the open/close cover 1010B in the closed state. The gap is formed over an entire surface of the covered part 1201 that is covered with the open/close cover 1010B in a widthwise direction of the covered part 1201. The widthwise direction of the covered part 1201 is a left-to-right direction in FIG. 11B and is hereinafter referred to as a covered part width direction. Therefore, the gap causes the open/close cover 1010B in the closed state not only to be visually awkward when viewed from the left side of FIG. 11B but also to increase an installation space of the image forming apparatus.

Referring back to FIGS. 10A and 10B, the open/close cover 10 in the open state as illustrated in FIG. 10B can be changed to the closed state as illustrated in FIG. 10A by rotating in a direction indicated by arrow A' in FIG. 10B. Hereinafter, the direction indicated by arrow A' is referred to as a direction A'.

Different from the cover open/close mechanism 1100A in FIG. 11A and the cover open/close mechanism 1100B in FIG. 11B, the cover rotating shaft 11 in the cover open/close mechanism 100 shown in FIG. 10A is not exposed even when the open/close cover 10 is in the closed state. Further, the gap between the open/close cover 10 and the surface of the covered part 201 of the apparatus body 200 is smaller than that in FIG. 11B. As a result, the open/close cover 10 can open/close without causing interference of the root side corner 12 with the covered part 201, and the external appearance of the image forming apparatus 500 in the closed state of the open/close cover 10 can be enhanced.

Figure 12A:
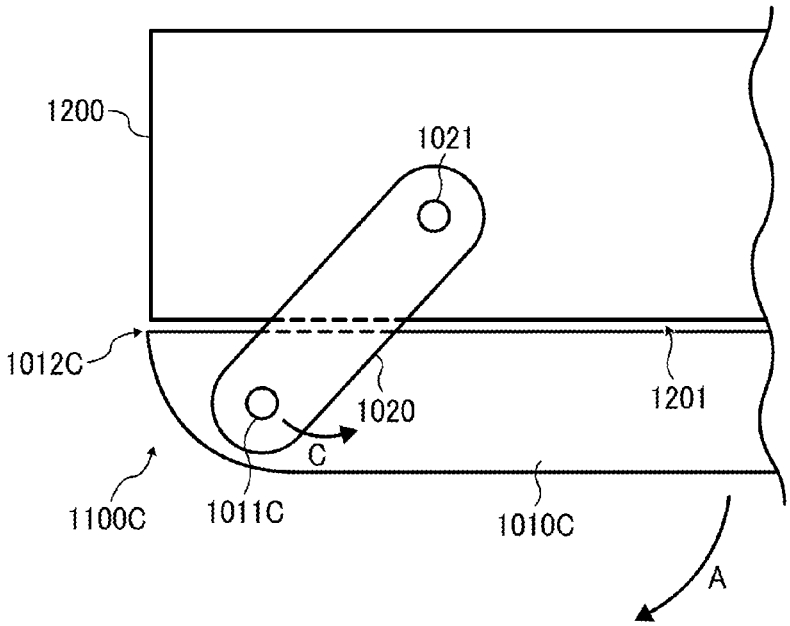
FIG. 12A is an enlarged top plan view illustrating yet another comparative cover open/close mechanism in a closed state having an arm and an arm rotating shaft.
Figure 12B:
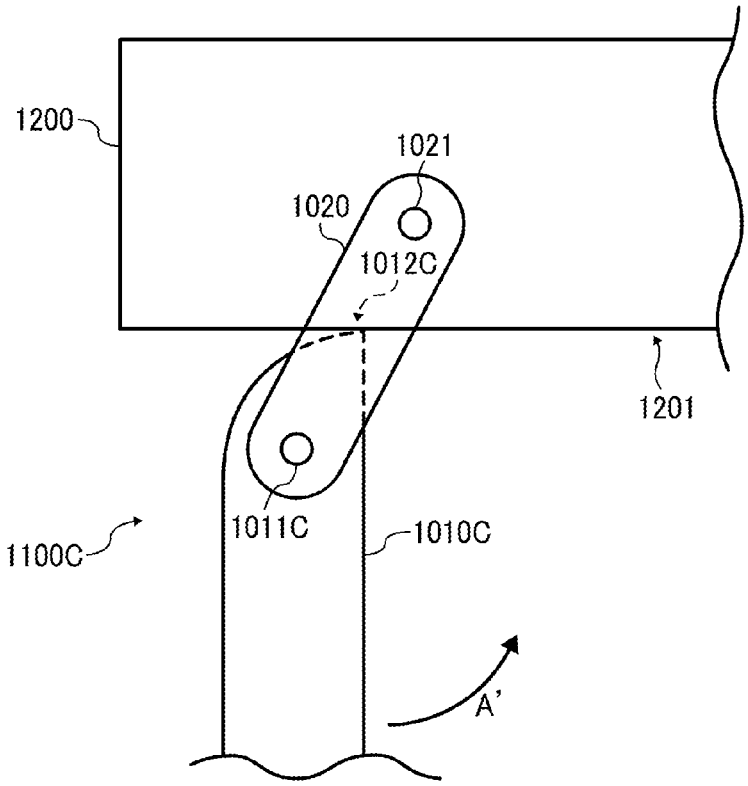
FIG. 12B is an enlarged top plan view illustrating the comparative cover open/close mechanism of FIG. 12A in an open state.

As another comparative example, a description is given of a configuration of a cover open/close mechanism 1100C and an area in the vicinity thereof with reference to FIGS. 12A and 12B.

FIGS. 12A and 12B show the comparative cover open/close mechanism 1100C including a cover rotating shaft 1011C, an arm 1020 that functions as a cover rotating shaft support member, and an arm rotating shaft 1021 that functions as a support member rotating shaft. FIG. 12A is an enlarged top plan view illustrating another comparative cover open/close mechanism 1100C and the vicinity area of the cover rotating shaft 1011C in a closed state. FIG. 12B is an enlarged plan view illustrating the comparative cover open/close mechanism 1100C and the vicinity area of the cover rotating shaft 1011C in an open state.

It is to be noted that the cover open/close mechanism 1100C has a configuration in which the axial center of the cover rotating shaft 1011C extends in a vertical direction while there is a different configuration in which the axial center of a cover rotating shaft extends in a horizontal direction.

In the cover open/close mechanism 1100C shown in FIG. 12A, an open/close cover 1010C is arranged to be close to the covered part 1201 of the apparatus body 1200 in the closed state. Consequently, as the open/close cover 1010C is rotated in the direction A in FIG. 12A, a root side corner 1012C rotates about the cover rotating shaft 1011C to abut against the surface of the covered part 1201. As the open/close cover 1010C is further rotated in the direction A in FIG. 12A, the root side corner 1012C presses the covered part 1201. However, the covered part 1201 is fixed with respect to the apparatus body 1200. Therefore, a push back force or a force in which the covered part 1201 pushes back the root side corner 1012C is applied to the cover rotating shaft 1011C via the open/close cover 1010C.

According to this action, the arm 1020 that supports the cover rotating shaft 1011C is rotated about the arm rotating shaft 1021 in the direction C in FIG. 12A, and the cover rotating shaft 1011C is rotated in the receding direction away from the covered part 1201. As a result of the movement of the cover rotating shaft 1011C moving in the receding direction from the covered part 1201, the open/close cover 1010C can be opened without causing interference of the root side corner 1012C with the covered part 1201.

Further, to change the open/close cover 1010C from the state shown in FIG. 12B to the state shown in FIG. 12A, the open/close cover 1010C is rotated in the direction A' illustrated in FIG. 12B.

In the cover open/close mechanism 1100C shown in FIGS. 12A and 12B, the cover rotating shaft 1011C is not exposed when the open/close cover 1010C is in the closed state and a gap formed between the open/close cover 1010C and the surface of the covered part 1201 is smaller than the gap between the open/close cover 1010B and the surface of the covered part 1201 as shown in FIG. 11B. With this configuration, the open/close cover 1010C can open/close without causing interference of the root side corner 1012C with the covered part 1201 and the quality of the external appearance of the image forming apparatus in the closed state is visually enhanced.

However, the cover open/close mechanism 1100C has the arm 1020 that supports the cover rotating shaft 1011C and that is rotatably disposed with respect to the apparatus body 1200. In this configuration, the open/close cover 1010C in the covered part width direction (i.e., the left-to-right direction in FIG. 12A) is located closer to the root end side of the open/close cover 1010C than to the arm rotating shaft 1021C in the closed state shown in FIG. 12A (i.e., on the left side of the drawing). Consequently, the cover rotating shaft 1011C can be moved toward the free end side (i.e., the right side) of the open/close cover 1010C than to the arm rotating shaft 1021 while the open/close cover 1010C is opening/closing. Specifically, a positional relation between the cover rotating shaft 1011C and the arm rotating shaft 1021 in the covered part width direction can be changed.

Figure 13A:
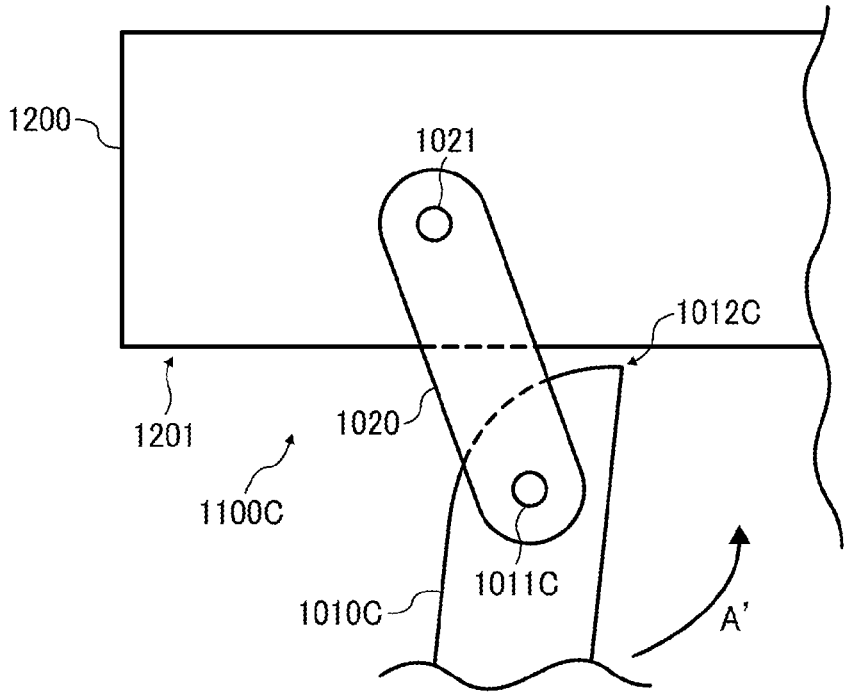
FIG. 13A is a diagram illustrating the comparative cover open/close mechanism, where a cover rotating shaft is shifted away from the arm rotating shaft toward a free end side of the open/close cover in the open state.
Figure 13B:
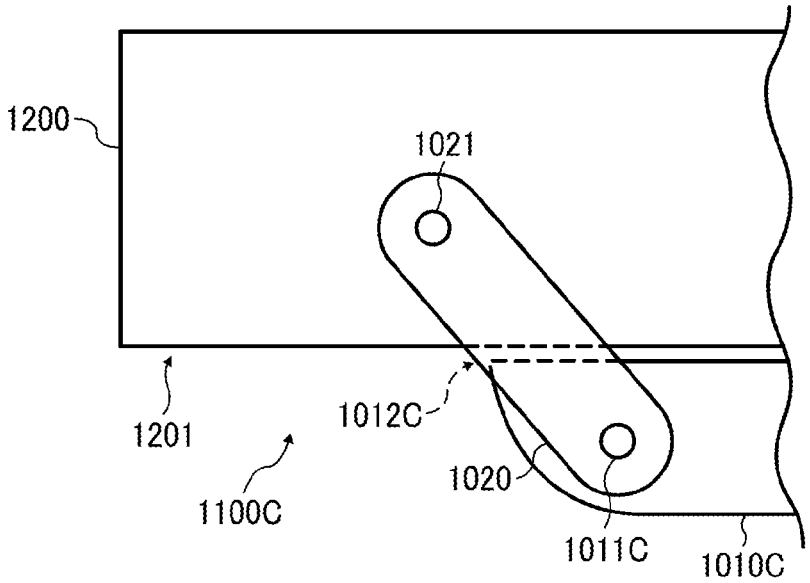
FIG. 13B is a diagram illustrating the comparative cover open/close mechanism, where the cover rotating shaft is shifted to a free end side of the open/close cover than the arm rotating shaft in the closed state.

FIGS. 13A and 13B are diagrams illustrating the comparative cover open/close mechanism 1100C, where the cover rotating shaft 1011C is shifted toward a free end of the open/close cover 1010C than to the arm rotating shaft 1021. FIG. 13A illustrates a state in which the open/close cover 1010C is in the closed state, and FIG. 13B illustrates a state in which the open/close cover 1010C is in the open state.

In the open state of the open/close cover 1010C in FIG. 12B, the arm 1020 can rotate freely. Therefore, as illustrated in FIG. 13A, the arm 1020 can rotates such that the cover rotating shaft 1011C is shifted toward the free end of the open/close cover 1010C than to the arm rotating shaft 1021 while the open/close cover 1010C is in the open state. By rotating the open/close cover 1010C in the direction A' from the state of FIG. 13A, the open/close cover 1010C comes off a correct position to be covered, as illustrated in FIG. 13B. Further, depending on the shape of the apparatus body 1200, the free end of the open/close cover 1010C is caught by the apparatus body 1200 before the open/close cover 1010C comes to the state shown in FIG. 13B. Therefore, the open/close cover 1010C cannot rotate in the direction A' further from the position where the free end of the open/close cover 1010C is caught by the apparatus body 1200.

Referring back to FIGS. 10A and 10B, the open/close cover 10 in the open state as illustrated in FIG. 10B can be changed to the closed state as illustrated in FIG. 10A by rotating in the direction A' in FIG. 10B.

The cover rotating shaft 11 in the cover open/close mechanism 100 shown in FIG. 10A is not exposed in the closed state. Further, the gap between the open/close cover 10 and the surface of the covered part 201 is smaller than that in FIG. 11B. As a result, the open/close cover 10 can open/close without causing interference of the root side corner 12 with the covered part 201, and the quality of the external appearance of the image forming apparatus 500 can be enhanced even when the open/close cover 10 is in the closed state.

In the cover open/close mechanism 1100C shown in FIGS. 12A, 12B, 13A, and 13B, the arm 1020 is rotatable freely around the arm rotating shaft 1021. In this configuration, it is likely that a position of the cover rotating shaft 11 in the covered part width direction (in the left-to-right direction in FIGS. 12A through 13B) becomes the same position as the arm rotating shaft 1021, which equals to a position indicated by a dot dashed line H in FIG. 10A. Under this positional relation, the cover rotating shaft 1011C comes to a farthest or distal position from the apparatus body 1200. Then, the arm 1020 rotates in the receding direction in which the cover rotating shaft 1011C in the closed state of the open/close cover 1010C separates from the apparatus body 1200 (which is the direction C in FIG. 12A), and the cover rotating shaft 1011C reaches the position indicated by the dot dashed line H in FIG. 10A. Thereafter, as the arm 1020 further rotates, the cover rotating shaft 1011C moves to the left side in FIG. 10A than to the arm rotating shaft 21, which results in a change in positions of the cover rotating shaft 11 and the arm rotating shaft 21.

By contrast, in the cover open/close mechanism 100 according to the present embodiment, the pressing member 25 biases the arm 20 so that the arm 20 rotates in the direction E in FIG. 10A to cause the cover rotating shaft 11 to approach the apparatus body 200. According to this configuration, the cover rotating shaft 11 comes to the farthest or distal position from the apparatus body 200. Specifically, this configuration can prevent the cover rotating shaft 11 from reaching the position indicated by the dot dashed line H in FIG. 10A. Consequently, this configuration can prevent a change in the positional relation between the cover rotating shaft 11 and the arm rotating shaft 21, and therefore can further prevent the unstable open/close operation of the open/close cover 10. As a result, the cover open/close mechanism 100 having the arm 20 can open/close the open/close cover 10 stably.

The covered part 201 is a part of the apparatus body 200 to be covered with the open/close cover 10 and is disposed facing and in the vicinity of the open/close cover 10 when the open/close cover 10 is in the closed state.

In the cover open/close mechanism 1100C illustrated in FIGS. 12A through 13B, the arm rotating shaft 1021 that is a rotating shaft of the arm 1020 is disposed inside the apparatus body 1200 from the covered part 1201. This configuration is indicated to have a space in the range of locus of the arm 1020 as well as a space to locate the arm rotating shaft 1021 so that the arm 1020 does not interfere with other parts or components disposed in the apparatus body 1200 even during rotation of the arm 1020. Securing such a space in the apparatus body 1200 can increase the size of the apparatus body 1200.

By contrast, in the cover open/close mechanism 100 having the configuration as illustrated in FIGS. 10A and 10B according to the present embodiment, the arm rotating shaft 21 is disposed outside the apparatus body 200 from the surface of the covered part 201. Specifically, in the cover open/close mechanism 100 according to the present embodiment, the arm rotating shaft support member 220 that is fixed to the apparatus body 200 is projected outwardly from the surface of the covered part 201 and is provided with the arm rotating shaft 21. With this configuration, the arm rotating shaft 21 is arranged to be outside the apparatus body 200 from the surface of the covered part 201. Accordingly, it is not required to secure any space for the tracking range of locus of the arm 20 in the apparatus body 200. As a result, an increase in size of the apparatus body 200 can be prevented.

However, with little disturbance, the arm 20 can rotate substantially freely in the configuration in which the arm rotating shaft 21 is disposed outside the apparatus body 200 from the surface of the covered part 201. Free rotation of the arm 20 can easily cause the open/close cover 10 to perform the unstable open/close operation such as a change in positional relation of the cover rotating shaft 11 and the arm rotating shaft 21 in the covered part width direction.

By contrast, the cover open/close mechanism 100 according to the present embodiment having the configuration as illustrated in FIGS. 10A and 10B includes the pressing member 25 that presses the arm 20 to prevent the arm 20 from rotating freely. Consequently, a stable open/close operation of the open/close cover 10 can be achieved.

In the cover open/close mechanism 100, the cover rotating shaft 11 falls within the range in a drawing in which the open/close cover 10 in the closed state is projected to be parallel to the Y-axis direction (in FIG. 6, for example). Also, the cover rotating shaft 11 is movable by rotating about the arm rotating shaft 21 that is a different rotating shaft. Accordingly, the open/close cover 10 rotates by moving the rotation center itself of the open/close cover 10. Further, the pressing member 25 such as a torsion spring limits the rotation range of the open/close cover 10.

Consequently, the open/close cover 10 can open/close reliably in a space-saving manner without affecting the external appearance of the image forming apparatus 500 and increasing the size of the image forming apparatus 500.

Next, a description is given of details the configuration of the cover open/close mechanism 100 according to the present embodiment with respect to FIGS. 5 through 9.

As previously described, FIGS. 7 through 9 are enlarged plan views illustrating the area in the vicinity of the open/close cover rotating shaft 11 of the open/close cover 10 of the cover open/close mechanism 100 in respective stages of the rotation locus of the open/close cover 10. FIG. 7 illustrates the open/close cover 10 in a stage S10C of the rotation locus of the open/close cover 10. FIG. 8 illustrates the open/close cover 10 in a stage S10D of the rotation locus of the open/close cover 10. FIG. 9 illustrates the open/close cover 10 in a stage S10E, which is a full open state. In the detailed description with reference to FIGS. 5 through 9, the cover end 15 of the open/close cover 10 corresponds to the root end (including the root side corner 12 illustrated in FIG. 10) of the open/close cover 10.

A space at the left side of the image forming apparatus 500 in FIG. 1 is an extension device installation region where an extension device such as a sheet biding device is installed. The region in FIG. 1 corresponds to the extension device installation region β in FIG. 5.

As illustrated in FIG. 5, the open/close cover 10 opens/closes by rotating about the cover rotating shaft 11 between the position thereof in the open state and the position thereof in the closed state. Similarly, the cover rotating shaft 11 moves by rotating about the arm rotating shaft 21.

The locus of the open/close cover 10 is set so as not to enter the region β at the left side of an outline 230 of the apparatus body 200. Therefore, even if an extension device is installed at the left side of the apparatus body 200 for functional extension, the open/close operation of the open/close cover 10 is not disturbed.

As the open/close cover 10 opens, a locus of the cover end 15 comes inside the outline 230 of the apparatus body 200, which is the right side in FIG. 6. However, the locus of the cover end 15 ranges within a thickness of the open/close cover 10, which is a vertical length of the open/close cover 10 in the closed state in FIG. 6. Therefore, no extra space to secure the range of the locus of the cover end 15 for pivoting the open/close cover 10 is required.

As described above, the arm 20 is biased by the pressing member 25 so that the arm 20 rotates about the arm rotating shaft 21 in the direction E in FIG. 6. With this configuration, the open/close cover 10 and the area in the vicinity of the cover rotating shaft 11 are biased upwardly in FIG. 6. However, the open/close cover 10 has a protruding portion 13 thereon to serve as an abutting portion. Since the protruding portion 13 abuts against the surface of the covered part 201 of the internal component 210 of the apparatus body 200, the rotation of the open/close cover 10 is stopped so as to maintain the closed state.

In the closed state of the open/close cover 10 illustrated in FIG. 6, the cover end 15 is located on or in the vicinity of a virtual plane including the surface of the covered part 201.

By arranging the cover end 15 as described above, the gap formed between the open/close cover 10 and the apparatus body 200 can be reduced, and therefore the quality of external appearance can be enhanced.

The cover end 15 corresponds to the root end that is located at the opposite end of the free end 10*a* of the open/close cover 10. The open/close cover 10 further has an outer surface 10*b* that works as an outside face of a part of the open/close cover 10 covering a target which the open/close cover 10 covers. When the open/close cover 10 is in the closed state as illustrated in FIG. 6, the cover end 15 is located closer to the apparatus body 200 (at an upper side in FIG. 6) than to the outer surface 10*b*.

Further, since the cover end 15 is located on or in the vicinity of the virtual plane, a position of the cover rotating shaft 11 in a direction perpendicular to the surface of the covered part 201 is substantially the same as the position of the cover end 15 in the closed state.

Further, the position of the surface of the covered part 201 with respect to the cover end 15 in the closed state of the open/close cover 10 can be closer to the outer surface 10*b* of the open/close cover 10 than to the cover end 15. By locating the surface of the covered part 201 closer to the outer surface 10*b*, the gap between the open/close cover 10 and the apparatus body 200 can be reduced or eliminated, and the quality of external appearance thereof can be enhanced.

With this arrangement, when a user moves the open/close cover 10 to open, the cover end 15 abuts against the apparatus body 200. However, in the configuration according to the present embodiment, by rotating the cover rotating shaft 11, the user can further move the open/close cover 10 to open even abutment of the cover end 15 against the apparatus body 200.

The comparative cover open/close mechanisms 1100A and 1100B shown in FIGS. 11A and 11B rotate the open/close cover 1010A/1010B about a single rotating shaft. In this configuration, the cover rotating shaft 1011A/1011B is indicated to be located on a normal line that passes the root side corner 1012A/1012B among normal lines of the surface of the covered part 1201 on a plane that is parallel to a horizontal plane. If the cover rotating shaft 11 is not on the normal line, the root side corner 1012A/1012B interferes with the covered part 1201.

By contrast, in the cover open/close mechanism 100 according to the present embodiment, although the cover rotating shaft 11 is not located on the normal line of the surface of the covered part 201 that passes the cover end 15, rotation of the arm 20 about the arm rotating shaft 21 can avoid the interference with the covered part 201.

A round portion 14 is formed on an area in the vicinity of the root end of the open/close cover 10 and has an end that corresponds to the cover end 15. Reference symbol "G" in FIG. 6 indicates an arc center that is a center of the arc-shaped round portion 14. Further, an angle θ1 (an obtuse angle) of a straight line J connecting the arc center G and the cover rotating shaft 11 and a normal line N of the surface of the covered part 201 that passes the cover end 15 among normal lines of the surface of the covered part 201 on the plane perpendicular to the cover rotating shaft 11 is equal to or greater than an opening angle θ2 of the open/close cover 10 with respect to the surface of the covered part 201 in the open state as shown in FIG. 9.

The arm 20 is biased in the direction E in FIG. 6 by the pressing member 25 wound around the arm rotating shaft 21. The biasing force applied by the pressing member 25 biases the arm 20 to maintain the open/close cover 10 in the closed state in FIG. 6 during a period of time within which the cover end 15 moves from the position as shown in FIG. 6 to the position on the surface of the covered part 201 of the internal component 210 as shown in FIG. 7.

When the user applies an external force to rotate the open/close cover 10 in the direction A in FIG. 6, the open/close cover 10 can be moved from the position in the closed state shown in FIG. 6 to the position in the open state shown in FIG. 7. When the user further rotates the open/close cover 10 to move the open/close cover 10 from the position in the open state shown in FIG. 7, the cover end 15 comes over the cover part 201 of the internal component 210 as shown in FIG. 8.

The open/close cover 10 gets to the state as shown in FIG. 8 when the user applies the external force to rotate the open/close cover 10 clockwise (in the direction A) from the position shown in FIG. 7 until the cover end 15 comes on the surface of the covered part 201 of the internal component 210 completely. At this time, an upward force exerted due to the biasing force by the pressing member 25 remains in the area in the vicinity of the cover rotating shaft 11. Accordingly, the open/close cover 10 rotates about the cover rotating shaft 11 while the round portion 14 of the outer surface 10*b* of the open/close cover 10 is slidably contacting the surface of the covered part 201 of the internal component 210. A distance between the surface of the covered part 201 and the cover rotating shaft 11 varies depending on the position of the round portion 14 on the surface of the covered part 201. When the open/close cover 10 rotates while the round portion 14 remains in contact with the surface of the covered part 201, the arm 20 rotates so that the distance between the surface of the covered part 201 and the cover rotating shaft 11 varies.

Therefore, as the open/close cover 10 in the state shown in FIG. 8 rotates clockwise, which is in the direction A in FIG. 8, the cover rotating shaft 11 further rotates to make a closest approach to the covered part 201 as shown in FIG. 9. Consequently, when the user rotates the open/close cover 10 until the cover end 15 comes on the surface of the covered part 201 that is fixed to the apparatus body 200, the open/close cover 10 moves automatically to the open state as shown in FIG. 9.

The arm 20 is biased by the pressing member 25 arranged around the arm rotating shaft 21 in the direction E shown in FIG. 9, so that the cover rotating shaft 11 and the open/close cover 10 are biased in an upward direction in FIG. 9.

FIG. 9 shows a state in which the round portion 14 of the open/close cover 10 remains in contact with the surface of the covered part 201 and the cover rotating shaft 11 comes closest to the surface of the covered part 201. In this state, a straight line connecting the cover rotating shaft 11 and the arc center G and a normal line of the surface of the covered part 201 at which the round portion 14 contacts the surface of the covered part 201 intersect.

When the user rotates the open/close cover 10 in FIG. 9 in either the direction A or the direction A', the cover rotating shaft 11 is indicated to move in the receding direction from the surface of the covered part 201 of the apparatus body 200 (e.g., an opposite direction of the direction E). Accordingly, the arm 20 is indicated to rotate against the biasing force that is applied by the pressing member 25. Therefore, when the open/close cover 10 gets to the state shown in FIG. 9, both the arm 20 and the open/close cover 10 cannot rotate any longer without application of the external force by the user, so that the open state of the open/close cover 10 is maintained.

Figure 14:
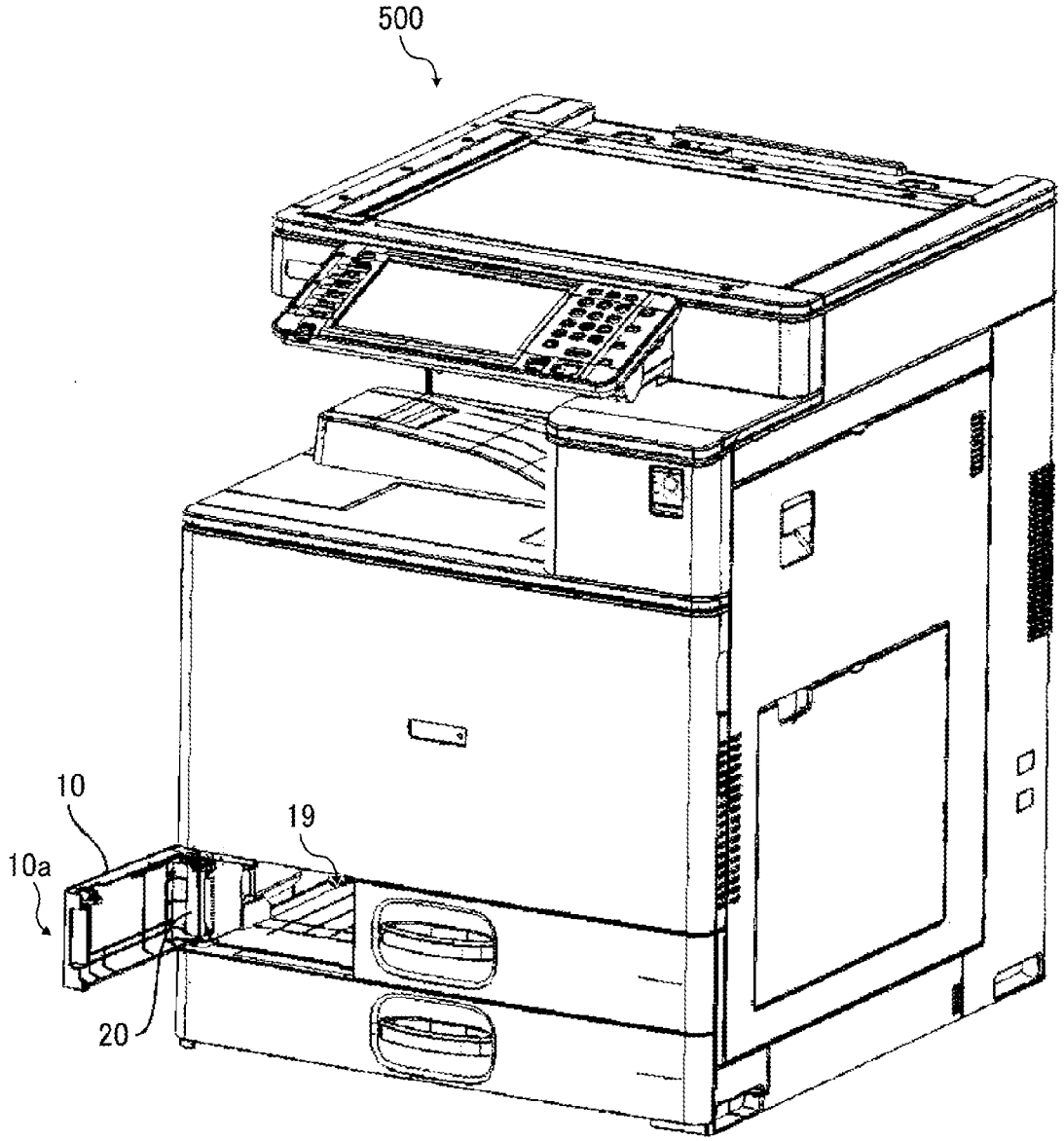
FIG. 14 is a perspective view illustrating an example of an image forming apparatus provided with a push latch member.

FIG. 14 is a perspective view illustrating an example configuration of the image forming apparatus 500 provided with a push type latch 19 functioning as a free end retaining member to hold the free end 10*a* in the closed state of the open/close cover 10.

As illustrated in FIG. 6, applying the biasing force by the pressing member 25 and abutting the protruding portion 13 against the apparatus body 200 can maintain the closed state of the open/close cover 10. By holding the free end 10*a* that does not have a hinge part such as the arm 20 in the closed state, the open/close cover 10 can show its robustness without rattling of a cover.

The free end 10*a* of the open/close cover 10 can be fixed and held by using screw or magnet. However, as illustrated in FIG. 14, the push type latch 19 can open the open/close cover 10 by pressing a given position of the open/close cover 10 from outside the open/close cover 10. With this configuration, a handle is no longer required for the user to grab the outer surface 10*b* of the open/close cover 10, and therefore the quality of the external appearance of the image forming apparatus 500 can be enhanced.

The configurations according to the above-described embodiment are examples. The present invention can achieve the following aspects effectively.

[Aspect A]

A cover open/close mechanism such as the cover open/close mechanism 100 includes a cover such as the open/close cover 10 having a free end such as the free end 10*a* in a width direction thereof and disposed movable between a closed state in which a part of an apparatus body such as the covered part 201 covering the waste toner bottle 300 provided in the apparatus body 200 is covered and an open state in which the covered part of the apparatus body is exposed, a cover rotating shaft such as the cover rotating shaft 11 about which the cover rotates in a direction in which the free end of the cover separates from the apparatus body when the cover changes from the closed state to the open state, a support member rotating shaft such as the arm rotating shaft 21 disposed parallel to the cover rotating shaft, and a cover rotating shaft support member such as the arm 20 to support the cover rotating shaft and to change a position of the cover rotating shaft with respect to the apparatus body by rotating about the support member rotating shaft. The cover open/close mechanism includes a biasing member such as the pressing member 25 to bias the cover rotating shaft support member in a manner in which the cover rotating shaft support member rotates in a direction in which the cover rotating shaft approaches the apparatus body.

According to Aspect A, as described in the above-described embodiment(s) and example(s), the cover open/close mechanism can provide a stable open/close operation of the cover.

[Aspect B]

In the cover open/close mechanism according to Aspect B, the cover such as the open/close cover 10 has a root end such as the cover end 15 which is an opposite end to the free end such as the free end 10*a* of the cover and is located closer to the apparatus body such as the apparatus body 200 than to an outer surface such as the outer surface 10*b* of the cover when the cover is in the closed state. The cover rotating shaft such as the cover rotating shaft 11 in a direction perpendicular to a surface of the covered part such as the covered part 201 of the apparatus body such as the apparatus body 201 is located at a position substantially same as the root end or closer to the outer surface of the cover than the root end is in the closed state.

According to Aspect B, as described in the above-described embodiment(s) and example(s), the quality of external appearance of the apparatus body of the image forming apparatus that includes the cover open/close mechanism such as the cover open/close mechanism 100 can be enhanced.

[Aspect C]

In the cover open/close mechanism according to Aspects A or B, the cover such as the open/close cover 10 has a root end such as the cover end 15 that is an opposite end to a free end such as the free end 10*a*, and an arc-shaped round portion such as the round portion 14 formed in the vicinity of the root end and having an arc center such as the arc center G thereof. The surface of the of the covered part such as the covered part 201 is covered with the cover in the closed state, is disposed facing the cover in the vicinity thereof, and has multiple normal lines on a plane perpendicular to the cover rotating shaft such as the cover rotating shaft 11 (as illustrated in FIG. 6). An obtuse angle such as the angle θ1 of a straight line such as the straight line J connecting the arc center of the round portion and the cover rotating shaft and a normal line such as the normal line N that passes the root end among the multiple normal lines is equal to or greater than an opening angle such as the angle θ2 of the cover with respect to the surface of the covered part in the open state.

According to Aspect C, as described in the above-described embodiment(s) and example(s), the cover can rotate until the cover reaches the state in which the straight line connecting the arc center of the round portion and the cover rotating shaft and the normal line of the surface of the covered part at a position where the round portion contacts the surface of the covered part. The angle of the cover with respect to the surface of the covered part this time becomes equal to an obtuse angle of angles of the straight line connecting the arc center of the round portion and the cover rotating shaft in the closed state of the cover and the normal line passing the cover rotating shaft. Accordingly, by setting the obtuse angle equal to or greater than the opening angle in the open state of the cover, a desired open state of the cover can be obtained.

[Aspect D]

In the cover open/close mechanism according to any of Aspects A through C, the cover such as the open/close cover 10 includes an abutting member such as the protruding portion 13 that is covered by the cover in the closed state and abuts by biasing of the biasing member such as the pressing member 25 against the surface of the covered part such as the covered part 201 that is proximately placed while facing the cover.

According to Aspect D, as described in the above-described embodiment(s) and example(s), by applying the biasing force by the biasing member and abutting the abutting member against the apparatus body such as the apparatus body 200 can maintain the closed state of the cover.

[Aspect E]

In the cover open/close mechanism according to any of Aspects A through D, the cover open/close mechanism further includes a free end retaining member to hold a free end such as the free end 10*a* in the closed state of the open/close cover such as the open/close cover 10.

According to Aspect E, as described in the above-described embodiment(s) and example(s), by holding the free end by the free end retaining member in the closed state, the cover such as the open/close cover 10 can show its robustness without rattling of the cover in the closed state.

[Aspect F]

In the cover open/close mechanism according to Aspect E, the free end retaining member is a push-type latch member such as the push type latch 19.

According to Aspect F, as described in the above-described embodiment(s) and example(s), a handle is no longer provided for the user to grab an outer surface such as the outer surface 10*b* of the cover such as the open/close cover 10 of the cover open/close mechanism such as the open/close mechanism 100, and therefore the quality of the external appearance of an image forming apparatus such as the image forming apparatus 500 can be enhanced.

[Aspect G]

An image forming apparatus such as the image forming apparatus 500 includes an image forming part such as the image forming part 60 that forms an image on a recording medium such as the transfer sheet P, and a cover open/close mechanism that opens/closes a cover to cover a part of an apparatus body. In the image forming apparatus, the cover open/close mechanism is the cover open close mechanism 100 according to any of Aspects A through F.

According to Aspect G, as described in the above-described embodiment(s) and example(s), the image forming apparatus is not affected by the quality of external appearance thereof, and can open/close the cover stably and reliably in a manner of space-saving without increasing the size thereof.

The above-described embodiments are illustrative and do not limit the present invention. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

What is claimed is:

1. A cover open/close mechanism comprising:

a cover having a free end in a width direction thereof and disposed movable between a closed state in which a part of an apparatus body is covered and an open state in which a covered part of the apparatus body is exposed;

a cover rotating shaft about which the cover rotates in a direction in which the free end of the cover separates from the apparatus body when the cover changes from the closed state to the open state;

a support member rotating shaft disposed parallel to the cover rotating shaft;

a cover rotating shaft support member to support the cover rotating shaft and to change a position of the cover rotating shaft with respect to the apparatus body by rotating about the support member rotating shaft; and a biasing member to bias the cover rotating shaft support member in a manner in which the cover rotating shaft support member rotates in a direction in which the cover rotating shaft approaches the apparatus body, wherein the biasing member biases the cover rotating shaft support member so that, relative to a position of the support member rotating shaft, the position of the cover rotating shaft moves to a side opposite a side at which a free end is placed in the closed state of the cover in a width direction of the apparatus body.

2. The cover open/close mechanism according to claim 1, wherein the cover has a root end that is an opposite end to the free end thereof and is located closer to the apparatus body than to an outer surface of the cover when the cover is in the closed state, wherein the cover rotating shaft in a direction perpendicular to a surface of the covered part is located at a position substantially the same as the root end or closer to the outer surface of the cover than the root end is in the closed state.

3. The cover open/close mechanism according to claim 1, wherein the cover has a root end that is an opposite end to the free end thereof, and an arc-shaped round portion formed in the vicinity of the root end and having an arc center thereof, wherein the surface of the covered part is covered with the cover in the closed state, is disposed facing and in the vicinity of the cover, and has multiple normal lines on a plane perpendicular to the cover rotating shaft, wherein an obtuse angle of a straight line connecting the arc center of the round portion and the cover rotating shaft and a normal line that passes the root end among the multiple normal lines is equal to or greater than an opening angle of the cover with respect to the surface of the covered part in the open state.

4. The cover open/close mechanism according to claim 1, wherein the cover comprises an abutting member covered by the cover in the closed state and to abut by biasing of the biasing member against the surface of the covered part of the apparatus body that is proximately placed while facing the cover.

5. The cover open/close mechanism according to claim 1, further comprising a free end retaining member to hold the free end of the cover in the closed state.

6. The cover open/close mechanism according to claim 5, wherein the free end retaining member is a push-type latch member.

7. An image forming apparatus comprising:

an image forming part to form an image on a recording medium; and the cover open/close mechanism according to claim 1.

* * * * *